US006530635B2

(12) United States Patent
Otsuki

(10) Patent No.: US 6,530,635 B2
(45) Date of Patent: Mar. 11, 2003

(54) COMBINATION OF BIDIRECTIONAL- AND UNIDIRECTIONAL-PRINTING USING PLURAL INK TYPES

(75) Inventor: Koichi Otsuki, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 22 days.

(21) Appl. No.: 09/727,759

(22) Filed: Dec. 4, 2000

(65) Prior Publication Data

US 2001/0006392 A1 Jul. 5, 2001

(30) Foreign Application Priority Data

Dec. 7, 1999 (JP) ..... 11-347341

(51) Int. Cl.[7] ..... B41J 2/07; B41J 2/21

(52) U.S. Cl. ..... 347/9; 347/12

(58) Field of Search ..... 347/9, 40, 41, 347/43, 12

(56) References Cited

U.S. PATENT DOCUMENTS 4,528,576 A 7/1985 Koumura et al.
5,971,524 A 10/1999 Nicoloff, Jr. et al.
6,145,961 A 11/2000 Otsuki
6,155,668 A 12/2000 Otsuki et al.
6,196,736 B1 3/2001 Otsuki et al.

FOREIGN PATENT DOCUMENTS

| | | |
|---|---|---|
| EP | 0 590 849 | 4/1994 |
| EP | 0 622 211 | 11/1994 |
| EP | 0 622 239 | 11/1994 |
| EP | 0 671 699 | 9/1995 |
| EP | 0 895 869 | 2/1999 |

*Primary Examiner*—Huan Tran
(74) *Attorney, Agent, or Firm*—Oblon, Spivak, McClelland, Maier & Neustadt, P.C.

(57) ABSTRACT

A printing head includes a first type nozzle groups for ejecting respective inks of a first ink group, and a second type nozzle group for ejecting respective inks of a second ink group. The second type nozzle group includes twice the number of nozzles in the first type nozzle group. On the forward passes of the main scanning, ink droplets are ejected from both the first type nozzle group and the second type nozzle group. On the reverse passes of the main scanning, ink droplets are ejected from only from the first type nozzle group. With respect to the first type nozzle group, the ejection timing of the ink droplets is corrected on the reverse passes of the main scanning on the basis of a specific correction value for dot misalignment.

19 Claims, 14 Drawing Sheets

FIRST EMBODIMENT: FIRST FEEDING METHOD
(1, 19) FEED

| PASS NUMBER | 1 | | 2 | | 3 | | 4 | |
|---|---|---|---|---|---|---|---|---|
| | FORWARD PASS→ | | | | | | | |
| RASTER NUMBER | C/M/Y | K1+K2 | REVERSE PASS← | | | | | |
| 1 | 1 | 1 | C/M/Y | K1+K2 | | | | |
| 2 | | 2 | 1 | | | | | |
| 3 | 2 | 3 | | | | | | |
| 4 | | 4 | 2 | | | | | |
| 5 | 3 | 5 | | | | | | |
| 6 | | 6 | 3 | | | | | |
| 7 | 4 | 7 | | | | | | |
| 8 | | 8 | 4 | | | | | |
| 9 | 5 | 9 | | | | | | |
| 10 | | 10 | 5 | | | | | |
| 11 | 6 | 11 | | | | | | |
| 12 | | 12 | 6 | | | | | |
| 13 | 7 | 13 | | | | | | |
| 14 | | 14 | 7 | | | | | |
| 15 | 8 | 15 | | | | | | |
| 16 | | 16 | 8 | | | | | |
| 17 | 9 | 17 | | | | | | |
| 18 | | 18 | 9 | | FORWARD PASS→ | | REVERSE PASS← | |
| 19 | 10 | 19 | | | C/M/Y | K1+K2 | C/M/Y | K1+K2 |
| 20 | | 20 | 10 | | | | | |
| 21 | | | | | 1 | 1 | | |
| 22 | | | | | | 2 | 1 | |
| 23 | | | | | 2 | 3 | | |
| 24 | | | | | | 4 | 2 | |
| 25 | | | | | 3 | 5 | | |
| 26 | | | | | | 6 | 3 | |
| 27 | | | | | 4 | 7 | | |
| 28 | | | | | | 8 | 4 | |
| 29 | | | | | 5 | 9 | | |
| 30 | | | | | | 10 | 5 | |
| 31 | | | | | 6 | 11 | | |
| 32 | | | | | | 12 | 6 | |
| 33 | | | | | 7 | 13 | | |
| 34 | | | | | | 14 | 7 | |
| 35 | | | | | 8 | 15 | | |
| 36 | | | | | | 16 | 8 | |
| 37 | | | | | 9 | 17 | | |
| 38 | | | | | | 18 | 9 | |
| 39 | | | | | 10 | 19 | | |
| 40 | | | | | | 20 | 10 | |
| 41 | | | | | | | | |

| PRINTING RESULTS | |
|---|---|
| COLOR | BLACK |
| FWD. 1 | FWD. 1 |
| REV. 1 | FWD. 2 |
| FWD. 2 | FWD. 3 |
| REV. 2 | FWD. 4 |
| FWD. 3 | FWD. 5 |
| REV. 3 | FWD. 6 |
| FWD. 4 | FWD. 7 |
| REV. 4 | FWD. 8 |
| FWD. 5 | FWD. 9 |
| REV. 5 | FWD. 10 |
| FWD. 6 | FWD. 11 |
| REV. 6 | FWD. 12 |
| FWD. 7 | FWD. 13 |
| REV. 7 | FWD. 14 |
| FWD. 8 | FWD. 15 |
| REV. 8 | FWD. 16 |
| FWD. 9 | FWD. 17 |
| REV. 9 | FWD. 18 |
| FWD. 10 | FWD. 19 |
| REV. 10 | FWD. 20 |
| FWD. 1 | FWD. 1 |
| REV. 1 | FWD. 2 |
| FWD. 2 | FWD. 3 |
| REV. 2 | FWD. 4 |
| FWD. 3 | FWD. 5 |
| REV. 3 | FWD. 6 |
| FWD. 4 | FWD. 7 |
| REV. 4 | FWD. 8 |
| FWD. 5 | FWD. 9 |
| REV. 5 | FWD. 10 |
| FWD. 6 | FWD. 11 |
| REV. 6 | FWD. 12 |
| FWD. 7 | FWD. 13 |
| REV. 7 | FWD. 14 |
| FWD. 8 | FWD. 15 |
| REV. 8 | FWD. 16 |
| FWD. 9 | FWD. 17 |
| REV. 9 | FWD. 18 |
| FWD. 10 | FWD. 19 |
| REV. 10 | FWD. 20 |

*Fig.6*

FIRST EMBODIMENT: FIRST FEEDING METHOD
(1, 19) FEED

| PASS NUMBER | 1 | | 2 | | 3 | | 4 | |
|---|---|---|---|---|---|---|---|---|
| | FORWARD PASS→ | | | | | | | |
| RASTER NUMBER | C/M/Y | K1+K2 | REVERSE PASS← | | | | | |
| | | | C/M/Y | K1+K2 | | | | |
| | | | | | FORWARD PASS→ | | | |
| | | | | | C/M/Y | K1+K2 | REVERSE PASS← | |
| | | | | | | | C/M/Y | K1+K2 |
| 1 | 1 | 1 | | | | | | |
| 2 | | 2 | 1 | | | | | |
| 3 | 2 | 3 | | | | | | |
| 4 | | 4 | 2 | | | | | |
| 5 | 3 | 5 | | | | | | |
| 6 | | 6 | 3 | | | | | |
| 7 | 4 | 7 | | | | | | |
| 8 | | 8 | 4 | | | | | |
| 9 | 5 | 9 | | | | | | |
| 10 | | 10 | 5 | | | | | |
| 11 | 6 | 11 | | | | | | |
| 12 | | 12 | 6 | | | | | |
| 13 | 7 | 13 | | | | | | |
| 14 | | 14 | 7 | | | | | |
| 15 | 8 | 15 | | | | | | |
| 16 | | 16 | 8 | | | | | |
| 17 | 9 | 17 | | | | | | |
| 18 | | 18 | 9 | | | | | |
| 19 | 10 | 19 | | | | | | |
| 20 | | 20 | 10 | | | | | |
| 21 | | | | | 1 | 1 | | |
| 22 | | | | | | 2 | 1 | |
| 23 | | | | | 2 | 3 | | |
| 24 | | | | | | 4 | 2 | |
| 25 | | | | | 3 | 5 | | |
| 26 | | | | | | 6 | 3 | |
| 27 | | | | | 4 | 7 | | |
| 28 | | | | | | 8 | 4 | |
| 29 | | | | | 5 | 9 | | |
| 30 | | | | | | 10 | 5 | |
| 31 | | | | | 6 | 11 | | |
| 32 | | | | | | 12 | 6 | |
| 33 | | | | | 7 | 13 | | |
| 34 | | | | | | 14 | 7 | |
| 35 | | | | | 8 | 15 | | |
| 36 | | | | | | 16 | 8 | |
| 37 | | | | | 9 | 17 | | |
| 38 | | | | | | 18 | 9 | |
| 39 | | | | | 10 | 19 | | |
| 40 | | | | | | 20 | 10 | |
| 41 | | | | | | | | |

| PRINTING RESULTS | |
|---|---|
| COLOR | BLACK |
| FWD. 1 | FWD. 1 |
| REV. 1 | FWD. 2 |
| FWD 2 | FWD. 3 |
| REV. 2 | FWD. 4 |
| FWD 3 | FWD. 5 |
| REV. 3 | FWD. 6 |
| FWD. 4 | FWD. 7 |
| REV. 4 | FWD. 8 |
| FWD. 5 | FWD. 9 |
| REV. 5 | FWD. 10 |
| FWD. 6 | FWD. 11 |
| REV. 6 | FWD. 12 |
| FWD. 7 | FWD. 13 |
| REV. 7 | FWD. 14 |
| FWD. 8 | FWD. 15 |
| REV. 8 | FWD. 16 |
| FWD. 9 | FWD. 17 |
| REV. 9 | FWD. 18 |
| FWD. 10 | FWD. 19 |
| REV. 10 | FWD. 20 |
| FWD. 1 | FWD. 1 |
| REV. 1 | FWD. 2 |
| FWD. 2 | FWD. 3 |
| REV. 2 | FWD. 4 |
| FWD. 3 | FWD. 5 |
| REV. 3 | FWD. 6 |
| FWD. 4 | FWD. 7 |
| REV. 4 | FWD. 8 |
| FWD. 5 | FWD. 9 |
| REV. 5 | FWD. 10 |
| FWD. 6 | FWD. 11 |
| REV. 6 | FWD. 12 |
| FWD. 7 | FWD. 13 |
| REV. 7 | FWD. 14 |
| FWD. 8 | FWD. 15 |
| REV. 8 | FWD. 16 |
| FWD. 9 | FWD. 17 |
| REV. 9 | FWD. 18 |
| FWD. 10 | FWD. 19 |
| REV. 10 | FWD. 20 |

*Fig.7*

FIRST EMBODIMENT: SECOND FEEDING METHOD
(9, 11) FEED

| PASS NUMBER | 1 | | 2 | | 3 | | 4 | | PRINTING RESULTS | |
|---|---|---|---|---|---|---|---|---|---|---|
| | FORWARD PASS→ | | | | | | | | | |
| RASTER NUMBER | C/M/Y | K1+K2 | | | | | | | COLOR | BLACK |
| 1 | 1 | 1 | | | | | | | FWD. 1 | FWD. 1 |
| 2 | | 2 | | | | | | | | FWD. 2 |
| 3 | 2 | 3 | | | | | | | FWD. 2 | FWD. 3 |
| 4 | | 4 | | | | | | | | FWD. 4 |
| 5 | 3 | 5 | | | | | | | FWD. 3 | FWD. 5 |
| 6 | | 6 | | | | | | | | FWD. 6 |
| 7 | 4 | 7 | REVERSE PASS← | | | | | | FWD. 4 | FWD. 7 |
| 8 | | 8 | | | | | | | | FWD. 8 |
| 9 | 5 | 9 | C/M/Y | K1+K2 | | | | | FWD. 5 | FWD. 9 |
| 10 | | 10 | 1 | | | | | | REV. 1 | FWD. 10 |
| 11 | 6 | 11 | | | | | | | FWD. 6 | FWD. 11 |
| 12 | | 12 | 2 | | | | | | REV. 2 | FWD. 12 |
| 13 | 7 | 13 | | | | | | | FWD. 7 | FWD. 13 |
| 14 | | 14 | 3 | | | | | | REV. 3 | FWD. 14 |
| 15 | 8 | 15 | | | | | | | FWD. 8 | FWD. 15 |
| 16 | | 16 | 4 | | | | | | REV. 4 | FWD. 16 |
| 17 | 9 | 17 | | | | | | | FWD. 9 | FWD. 17 |
| 18 | | 18 | 5 | | FORWARD PASS→ | | | | REV. 5 | FWD. 18 |
| 19 | 10 | 19 | | | | | | | FWD. 10 | FWD. 19 |
| 20 | | 20 | 6 | | C/M/Y | K1+K2 | | | REV. 6 | FWD. 20 |
| 21 | | | | | 1 | 1 | | | FWD. 1 | FWD. 1 |
| 22 | | | 7 | | | 2 | | | REV. 7 | FWD. 2 |
| 23 | | | | | 2 | 3 | | | FWD. 2 | FWD. 3 |
| 24 | | | 8 | | | 4 | | | REV. 8 | FWD. 4 |
| 25 | | | | | 3 | 5 | | | FWD. 3 | FWD. 5 |
| 26 | | | 9 | | | 6 | | | REV. 9 | FWD. 6 |
| 27 | | | | | 4 | 7 | REVERSE PASS← | | FWD. 4 | FWD. 7 |
| 28 | | | 10 | | | 8 | | | REV. 10 | FWD. 8 |
| 29 | | | | | 5 | 9 | C/M/Y | K1+K2 | FWD. 5 | FWD. 9 |
| 30 | | | | | | 10 | 1 | | REV. 1 | FWD. 10 |
| 31 | | | | | 6 | 11 | | | FWD. 6 | FWD. 11 |
| 32 | | | | | | 12 | 2 | | REV. 2 | FWD. 12 |
| 33 | | | | | 7 | 13 | | | FWD. 7 | FWD. 13 |
| 34 | | | | | | 14 | 3 | | REV. 3 | FWD. 14 |
| 35 | | | | | 8 | 15 | | | FWD. 8 | FWD. 15 |
| 36 | | | | | | 16 | 4 | | REV. 4 | FWD. 16 |
| 37 | | | | | 9 | 17 | | | FWD. 9 | FWD. 17 |
| 38 | | | | | | 18 | 5 | | REV. 5 | FWD. 18 |
| 39 | | | | | 10 | 19 | | | FWD. 10 | FWD. 19 |
| 40 | | | | | | 20 | 6 | | REV. 6 | FWD. 20 |
| 41 | | | | | | | | | FWD. 1 | FWD. 1 |

*Fig. 10*

SECOND EMBODIMENT: FIRST FEEDING METHOD
(1,19) FEED

| PASS NUMBER | 1 | | 2 | | 3 | | 4 | | 5 | | 6 | | 7 | | 8 | |
|---|---|---|---|---|---|---|---|---|---|---|---|---|---|---|---|---|
| | FORWARD PASS→ | | | | | | | | | | | | | | | |
| RASTER NUMBER | C/M/Y | K1+K2 | REVERSE PASS← | | | | | | | | | | | | | |
| | | | C/M/Y | K1+K2 | | | | | | | | | | | | |
| 1 | 1 | 1 | | | | | | | | | | | | | | |
| 2 | | | 1 | | | | | | | | | | | | | |
| 3 | 2 | 2 | | | | | | | | | | | | | | |
| 4 | | | 2 | | | | | | | | | | | | | |
| 5 | 3 | 3 | | | | | | | | | | | | | | |
| 6 | | | 3 | | | | | | | | | | | | | |
| 7 | 4 | 4 | | | | | | | | | | | | | | |
| 8 | | | 4 | | | | | | | | | | | | | |
| 9 | 5 | 5 | | | | | | | | | | | | | | |
| 10 | | | 5 | | | | | | | | | | | | | |
| 11 | 6 | 6 | | | | | | | | | | | | | | |
| 12 | | | 6 | | | | | | | | | | | | | |
| 13 | 7 | 7 | | | | | | | | | | | | | | |
| 14 | | | 7 | | | | | | | | | | | | | |
| 15 | 8 | 8 | | | | | | | | | | | | | | |
| 16 | | | 8 | | | | | | | | | | | | | |
| 17 | 9 | 9 | | | | | | | | | | | | | | |
| 18 | | | 9 | | FORWARD PASS→ | | | | | | | | | | | |
| 19 | 10 | 10 | | | | | REVERSE PASS← | | | | | | | | | |
| 20 | | 11 | 10 | | C/M/Y | K1+K2 | | | | | | | | | | |
| 21 | | | | | 1 | 1 | C/M/Y | K1+K2 | | | | | | | | |
| 22 | | 12 | | | | | 1 | | | | | | | | | |
| 23 | | | | | 2 | 2 | | | | | | | | | | |
| 24 | | 13 | | | | | 2 | | | | | | | | | |
| 25 | | | | | 3 | 3 | | | | | | | | | | |
| 26 | | 14 | | | | | 3 | | | | | | | | | |
| 27 | | | | | 4 | 4 | | | | | | | | | | |
| 28 | | 14 | | | | | 4 | | | | | | | | | |
| 29 | | | | | 5 | 5 | | | | | | | | | | |
| 30 | | 16 | | | | | 5 | | | | | | | | | |
| 31 | | | | | 6 | 6 | | | | | | | | | | |
| 32 | | 17 | | | | | 6 | | | | | | | | | |
| 33 | | | | | 7 | 7 | | | | | | | | | | |
| 34 | | 18 | | | | | 7 | | | | | | | | | |
| 35 | | | | | 8 | 8 | | | | | | | | | | |
| 36 | | 19 | | | | | 8 | | | | | | | | | |
| 37 | | | | | 9 | 9 | | | | | | | | | | |
| 38 | | 20 | | | | | 9 | | FORWARD PASS→ | | | | | | | |
| 39 | | | | | 10 | 10 | | | | | REVERSE PASS← | | | | | |
| 40 | | | | | | 11 | 10 | | C/M/Y | K1+K2 | | | | | | |
| 41 | | | | | | | | | 1 | 1 | C/M/Y | K1+K2 | | | | |
| 42 | | | | | | 12 | | | | | 1 | | | | | |
| 43 | | | | | | | | | 2 | 2 | | | | | | |
| 44 | | | | | | 13 | | | | | 2 | | | | | |
| 45 | | | | | | | | | 3 | 3 | | | | | | |
| 46 | | | | | | 14 | | | | | 3 | | | | | |
| 47 | | | | | | | | | 4 | 4 | | | | | | |
| 48 | | | | | | 14 | | | | | 4 | | | | | |
| 49 | | | | | | | | | 5 | 5 | | | | | | |
| 50 | | | | | | 16 | | | | | 5 | | | | | |
| 51 | | | | | | | | | 6 | 6 | | | | | | |
| 52 | | | | | | 17 | | | | | 6 | | | | | |
| 53 | | | | | | | | | 7 | 7 | | | | | | |
| 54 | | | | | | 18 | | | | | 7 | | | | | |
| 55 | | | | | | | | | 8 | 8 | | | | | | |
| 56 | | | | | | 19 | | | | | 8 | | | | | |
| 57 | | | | | | | | | 9 | 9 | | | | | | |
| 58 | | | | | | 20 | | | | | 9 | | FORWARD PASS→ | | | |
| 59 | | | | | | | | | 10 | 10 | | | | | REVERSE PASS← | |
| 60 | | | | | | | | | | 11 | 10 | | C/M/Y | K1+K2 | | |
| 61 | | | | | | | | | | | | | 1 | 1 | C/M/Y | K1+K2 |
| 62 | | | | | | | | | | 12 | | | | | 1 | |
| 63 | | | | | | | | | | | | | 2 | 2 | | |
| 64 | | | | | | | | | | 13 | | | | | 2 | |

*Fig. 11*

SECOND EMBODIMENT: FIRST FEEDING METHOD
(1,19) FEED

<PRINTING RESULTS/COLORED INKS>

| RASTER NUMBER | | | | | | | |
|---|---|---|---|---|---|---|---|
| 1 | 1FWD. 1 | | | | | | |
| 2 | | 2REV. 1 | | | | | |
| 3 | 1FWD. 2 | | | | | | |
| 4 | | 2REV. 2 | | | | | |
| 5 | 1FWD. 3 | | | | | | |
| 6 | | 2REV. 3 | | | | | |
| 7 | 1FWD. 4 | | | | | | |
| 8 | | 2REV. 4 | | | | | |
| 9 | 1FWD. 5 | | | | | | |
| 10 | | 2REV. 5 | | | | | |
| 11 | 1FWD. 6 | | | | | | |
| 12 | | 2REV. 6 | | | | | |
| 13 | 1FWD. 7 | | | | | | |
| 14 | | 2REV. 7 | | | | | |
| 15 | 1FWD. 8 | | | | | | |
| 16 | | 2REV. 8 | | | | | |
| 17 | 1FWD. 9 | | | | | | |
| 18 | | 2REV. 9 | | | | | |
| 19 | 1FWD. 10 | | | | | | |
| 20 | | 2REV. 10 | | | | | |
| 21 | | | 3FWD. 1 | | | | |
| 22 | | | | 4REV. 1 | | | |
| 23 | | | 3FWD. 2 | | | | |
| 24 | | | | 4REV. 2 | | | |
| 25 | | | 3FWD. 3 | | | | |
| 26 | | | | 4REV. 3 | | | |
| 27 | | | 3FWD. 4 | | | | |
| 28 | | | | 4REV. 4 | | | |
| 29 | | | 3FWD. 5 | | | | |
| 30 | | | | 4REV. 5 | | | |
| 31 | | | 3FWD. 6 | | | | |
| 32 | | | | 4REV. 6 | | | |
| 33 | | | 3FWD. 7 | | | | |
| 34 | | | | 4REV. 7 | | | |
| 35 | | | 3FWD. 8 | | | | |
| 36 | | | | 4REV. 8 | | | |
| 37 | | | 3FWD. 9 | | | | |
| 38 | | | | 4REV. 9 | | | |
| 39 | | | 3FWD. 10 | | | | |
| 40 | | | | 4REV. 10 | | | |
| 41 | | | | | 5FWD. 1 | | |
| 42 | | | | | | 6REV. 1 | |
| 43 | | | | | 5FWD. 2 | | |
| 44 | | | | | | 6REV. 2 | |
| 45 | | | | | 5FWD. 3 | | |
| 46 | | | | | | 6REV. 3 | |
| 47 | | | | | 5FWD. 4 | | |
| 48 | | | | | | 6REV. 4 | |
| 49 | | | | | 5FWD. 5 | | |
| 50 | | | | | | 6REV. 5 | |
| 51 | | | | | 5FWD. 6 | | |
| 52 | | | | | | 6REV. 6 | |
| 53 | | | | | 5FWD. 7 | | |
| 54 | | | | | | 6REV. 7 | |
| 55 | | | | | 5FWD. 8 | | |
| 56 | | | | | | 6REV. 8 | |
| 57 | | | | | 5FWD. 9 | | |
| 58 | | | | | | 6REV. 9 | |
| 59 | | | | | 5FWD. 10 | | |
| 60 | | | | | | 6REV. 10 | |
| 61 | | | | | | | 7FWD. 1 |
| 62 | | | | | | | | 8FWD. 1 |
| 63 | | | | | | | 7FWD. 2 |
| 64 | | | | | | | | 8FWD. 2 |

<PRINTING RESULTS/BLACK INK>

| RASTER NUMBER | | | | | |
|---|---|---|---|---|---|
| 1 | 1FWD. 1 | | | | |
| 2 | | | | | |
| 3 | 1FWD. 2 | | | | |
| 4 | | | | | |
| 5 | 1FWD. 3 | | | | |
| 6 | | | | | |
| 7 | 1FWD. 4 | | | | |
| 8 | | | | | |
| 9 | 1FWD. 5 | | | | |
| 10 | | | | | |
| 11 | 1FWD. 6 | | | | |
| 12 | | | | | |
| 13 | 1FWD. 7 | | | | |
| 14 | | | | | |
| 15 | 1FWD. 8 | | | | |
| 16 | | | | | |
| 17 | 1FWD. 9 | | | | |
| 18 | | | | | |
| 19 | 1FWD. 10 | | | | |
| 20 | 1FWD. 11 | | | | |
| 21 | | 3FWD. 1 | | | |
| 22 | 1FWD. 12 | | | | |
| 23 | | 3FWD. 2 | | | |
| 24 | 1FWD. 13 | | | | |
| 25 | | 3FWD. 3 | | | |
| 26 | 1FWD. 14 | | | | |
| 27 | | 3FWD. 4 | | | |
| 28 | 1FWD. 15 | | | | |
| 29 | | 3FWD. 5 | | | |
| 30 | 1FWD. 16 | | | | |
| 31 | | 3FWD. 6 | | | |
| 32 | 1FWD. 17 | | | | |
| 33 | | 3FWD. 7 | | | |
| 34 | 1FWD. 18 | | | | |
| 35 | | 3FWD. 8 | | | |
| 36 | 1FWD. 19 | | | | |
| 37 | | 3FWD. 9 | | | |
| 38 | 1FWD. 20 | | | | |
| 39 | | 3FWD. 10 | | | |
| 40 | | 3FWD. 11 | | | |
| 41 | | | 5FWD. 1 | | |
| 42 | | 3FWD. 2 | | | |
| 43 | | | 5FWD. 2 | | |
| 44 | | 3FWD. 4 | | | |
| 45 | | | 5FWD. 3 | | |
| 46 | | 3FWD. 14 | | | |
| 47 | | | 5FWD. 4 | | |
| 48 | | 3FWD. 15 | | | |
| 49 | | | 5FWD. 5 | | |
| 50 | | 3FWD. 16 | | | |
| 51 | | | 5FWD. 6 | | |
| 52 | | 3FWD. 17 | | | |
| 53 | | | 5FWD. 7 | | |
| 54 | | 3FWD. 18 | | | |
| 55 | | | 5FWD. 8 | | |
| 56 | | 3FWD. 19 | | | |
| 57 | | | 5FWD. 9 | | |
| 58 | | 3FWD. 20 | | | |
| 59 | | | 5FWD. 10 | | |
| 60 | | | 5FWD. 11 | | |
| 61 | | | | 7FWD. 1 | |
| 62 | | | 5FWD. 12 | | |
| 63 | | | | 7FWD. 2 | |
| 64 | | | 5FWD. 13 | | |

Fig. 12

SECOND EMBODIMENT: SECOND FEEDING METHOD (5, 5) FEED

| PASS NUMBER | 1 | | 2 | | 3 | | 4 | | 5 | | 6 | | 7 | | 8 | |
|---|---|---|---|---|---|---|---|---|---|---|---|---|---|---|---|---|
| | FORWARD PASS→ | | | | | | | | | | | | | | | |
| RASTER NUMBER | C/M/Y | K1+K2 | | | | | | | | | | | | | | |
| 1 | 1 | 1 | | | | | | | | | | | | | | |
| 2 | | | | | | | | | | | | | | | | |
| 3 | 2 | 2 | | | | | | | | | | | | | | |
| 4 | | | REVERSE PASS ← | | | | | | | | | | | | | |
| 5 | 3 | 3 | C/M/Y | K1+K2 | | | | | | | | | | | | |
| 6 | | | 1 | | | | | | | | | | | | | |
| 7 | 4 | 4 | | | | | | | | | | | | | | |
| 8 | | | 2 | | | | | | | | | | | | | |
| 9 | 5 | 5 | | | FORWARD PASS→ | | | | | | | | | | | |
| 10 | | | 3 | | C/M/Y | K1+K2 | | | | | | | | | | |
| 11 | 6 | 6 | | | 1 | 1 | | | | | | | | | | |
| 12 | | | 4 | | | | | | | | | | | | | |
| 13 | 7 | 7 | | | 2 | 2 | | | | | | | | | | |
| 14 | | | 5 | | | | REVERSE PASS ← | | | | | | | | | |
| 15 | 8 | 8 | | | 3 | 3 | C/M/Y | K1+K2 | | | | | | | | |
| 16 | | | 6 | | | | 1 | | | | | | | | | |
| 17 | 9 | 9 | | | 4 | 4 | | | | | | | | | | |
| 18 | | | 7 | | | | 2 | | | | | | | | | |
| 19 | 10 | 10 | | | 5 | 5 | | | FORWARD PASS→ | | | | | | | |
| 20 | | 11 | 8 | | | | 3 | | C/M/Y | K1+K2 | | | | | | |
| 21 | | | | | 6 | 6 | | | 1 | 1 | | | | | | |
| 22 | | 12 | 9 | | | | 4 | | | | | | | | | |
| 23 | | | | | 7 | 7 | | | 2 | 2 | | | | | | |
| 24 | | 13 | 10 | | | | 5 | | | | REVERSE PASS ← | | | | | |
| 25 | | | | | 8 | 8 | | | 3 | 3 | C/M/Y | K1+K2 | | | | |
| 26 | | 14 | | | | | 6 | | | | 1 | | | | | |
| 27 | | | | | 9 | 9 | | | 4 | 4 | | | | | | |
| 28 | | 14 | | | | | 7 | | | | 2 | | | | | |
| 29 | | | | | 10 | 10 | | | 5 | 5 | | | FORWARD PASS→ | | | |
| 30 | | 16 | | | | 11 | 8 | | | | 3 | | C/M/Y | K1+K2 | | |
| 31 | | | | | | | | | 6 | 6 | | | 1 | 1 | | |
| 32 | | 17 | | | | 12 | 9 | | | | 4 | | | | | |
| 33 | | | | | | | | | 7 | 7 | | | 2 | 2 | | |
| 34 | | 18 | | | | 13 | 10 | | | | 5 | | | | | |
| 35 | | | | | | | | | 8 | 8 | | | 3 | 3 | | |
| 36 | | 19 | | | | 14 | | | | | 6 | | | | REVERSE PASS ← | |
| 37 | | | | | | | | | 9 | 9 | | | 4 | 4 | C/M/Y | K1+K2 |
| 38 | | 20 | | | | 14 | | | | | 7 | | | | 1 | |
| 39 | | | | | | | | | 10 | 10 | | | 5 | 5 | | |
| 40 | | | | | | 16 | | | | 11 | 8 | | | | 2 | |
| 41 | | | | | | | | | | | | | 6 | 6 | | |
| 42 | | | | | | 17 | | | | 12 | 9 | | | | 3 | |
| 43 | | | | | | | | | | | | | 7 | 7 | | |
| 44 | | | | | | 18 | | | | 13 | 10 | | | | 4 | |

Fig. 13

SECOND EMBODIMENT: SECOND FEEDING METHOD (5, 5) FEED

<PRINTING RESULTS/COLORED INKS>

| RASTER NUMBER | | | | | | | |
|---|---|---|---|---|---|---|---|
| 1 | 1FWD. 1 | | | | | | |
| 2 | | | | | | | |
| 3 | 1FWD. 2 | | | | | | |
| 4 | | | | | | | |
| 5 | 1FWD. 3 | | | | | | |
| 6 | | 2REV. 1 | | | | | |
| 7 | 1FWD. 4 | | | | | | |
| 8 | | 2REV. 2 | | | | | |
| 9 | 1FWD. 5 | | | | | | |
| 10 | | 2REV. 3 | | | | | |
| 11 | 1FWD. 6 | | 3FWD. 1 | | | | |
| 12 | | 2REV. 4 | | | | | |
| 13 | 1FWD. 7 | | 3FWD. 2 | | | | |
| 14 | | 2REV. 5 | | | | | |
| 15 | 1FWD. 8 | | 3FWD. 3 | | | | |
| 16 | | 2REV. 6 | | 4REV. 1 | | | |
| 17 | 1FWD. 9 | | 3FWD. 4 | | | | |
| 18 | | 2REV. 7 | | 4REV. 2 | | | |
| 19 | 1FWD. 10 | | 3FWD. 5 | | | | |
| 20 | | 2REV. 8 | | 4REV. 3 | | | |
| 21 | | | 3FWD. 6 | | 5FWD. 1 | | |
| 22 | | 2REV. 9 | | 4REV. 4 | | | |
| 23 | | | 3FWD. 7 | | 5FWD. 2 | | |
| 24 | | 2REV. 10 | | 4REV. 5 | | | |
| 25 | | | 3FWD. 8 | | 5FWD. 3 | | |
| 26 | | | | 4REV. 6 | | 6REV. 1 | |
| 27 | | | 3FWD. 9 | | 5FWD. 4 | | |
| 28 | | | | 4REV. 7 | | 6REV. 2 | |
| 29 | | | 3FWD. 10 | | 5FWD. 5 | | |
| 30 | | | | 4REV. 8 | | 6REV. 3 | |
| 31 | | | | | 5FWD. 6 | | 7FWD. 1 |
| 32 | | | | 4REV. 9 | | 6REV. 4 | |
| 33 | | | | | 5FWD. 7 | | 7FWD. 2 |
| 34 | | | | 4REV. 10 | | 6REV. 5 | |
| 35 | | | | | 5FWD. 8 | | 7FWD. 3 |
| 36 | | | | | | 6REV. 6 | | 8REV. 1 |
| 37 | | | | | 5FWD. 9 | | 7FWD. 4 | |
| 38 | | | | | | 6REV. 7 | | 8REV. 2 |
| 39 | | | | | 5FWD. 10 | | 7FWD. 5 | |
| 40 | | | | | | 6REV. 8 | | 8REV. 3 |
| 41 | | | | | | | 7FWD. 6 | |
| 42 | | | | | | 6REV. 9 | | 8REV. 4 |
| 43 | | | | | | | 7FWD. 7 | |
| 44 | | | | | | 6REV. 10 | | 8REV. 5 |

<PRINTING RESULTS/BLACK INK>

| RASTER NUMBER | | | | | |
|---|---|---|---|---|---|
| 1 | 1FWD. 1 | | | | |
| 2 | | | | | |
| 3 | 1FWD. 2 | | | | |
| 4 | | | | | |
| 5 | 1FWD. 3 | | | | |
| 6 | | | | | |
| 7 | 1FWD. 4 | | | | |
| 8 | | | | | |
| 9 | 1FWD. 5 | | | | |
| 10 | | | | | |
| 11 | 1FWD. 6 | 3FWD. 1 | | | |
| 12 | | | | | |
| 13 | 1FWD. 7 | 3FWD. 2 | | | |
| 14 | | | | | |
| 15 | 1FWD. 8 | 3FWD. 3 | | | |
| 16 | | | | | |
| 17 | 1FWD. 9 | 3FWD. 4 | | | |
| 18 | | | | | |
| 19 | 1FWD. 10 | 3FWD. 5 | | | |
| 20 | 1FWD. 11 | | | | |
| 21 | | 3FWD. 6 | 5FWD. 1 | | |
| 22 | 1FWD. 12 | | | | |
| 23 | | 3FWD. 7 | 5FWD. 2 | | |
| 24 | 1FWD. 13 | | | | |
| 25 | | 3FWD. 8 | 5FWD. 3 | | |
| 26 | 1FWD. 14 | | | | |
| 27 | | 3FWD. 9 | 5FWD. 4 | | |
| 28 | 1FWD. 15 | | | | |
| 29 | | 3FWD. 10 | 5FWD. 5 | | |
| 30 | 1FWD. 16 | 3FWD. 11 | | | |
| 31 | | | 5FWD. 6 | 7FWD. 1 | |
| 32 | 1FWD. 17 | 3FWD. 12 | | | |
| 33 | | | 5FWD. 7 | 7FWD. 2 | |
| 34 | 1FWD. 18 | 3FWD. 13 | | | |
| 35 | | | 5FWD. 8 | 7FWD. 3 | |
| 36 | 1FWD. 19 | 3FWD. 14 | | | |
| 37 | | | 5FWD. 9 | 7FWD. 4 | |
| 38 | 1FWD. 20 | 3FWD. 15 | | | |
| 39 | | | 5FWD. 10 | 7FWD. 5 | |
| 40 | | 3FWD. 16 | 5FWD. 11 | | |
| 41 | | | | 7FWD. 6 | 9FWD. 1 |
| 42 | | 3FWD. 17 | 5FWD. 12 | | |
| 43 | | | | 7FWD. 7 | 9FWD. 2 |
| 44 | | 3FWD. 18 | 5FWD. 13 | | |

COMBINATION OF BIDIRECTIONAL- AND UNIDIRECTIONAL-PRINTING USING PLURAL INK TYPES

BACKGROUND OF THE INVENTION

1. Field of the Invention

The present invention relates to a technique for printing images on a printing medium while performing bidirectional main scanning.

2. Description of the Related Art

In recent years, color inkjet printers have spread widely as computer output devices. Inkjet printers typically have a print head including plural nozzles for ejecting ink droplets to form dots on a print medium. Some inkjet printers have a function of so-called "bidirectional printing" in order to increase the printing speed.

In the case of bidirectional printing, a print head ejects ink droplets along both the forward and reverse passes of main scanning; as a result, the travel direction of the ink droplets is reversed on the forward and reverse passes. This tends to cause dot misalignment in the main scanning direction. Japanese Laid-Open Gazette No. 5-69625 discloses a technique for solving this dot misalignment problem. In this conventional technique, the amount of the dot misalignment is registered beforehand, and the recording positions of the dots on the forward and reverse passes are corrected on the basis of this amount of dot misalignment.

Since the travel velocity of the ink droplets is different for the respective inks, such as black, cyan, magenta, and yellow inks, the amount of dot misalignment depends on the type of ink. Accordingly, it is desirable that the dot misalignment correction be performed separately for each type of ink. However, since the required control is complicated in such a case, the correction is usually performed for the printing head as a whole. In such cases, a single correction amount that takes into consideration all of the inks used is determined, and the dot misalignment correction is commonly performed to all of the inks with the single correction amount.

A print having color drawings often includes characters and tables with ink of a single color such as black ink. If the dot misalignment correction is made commonly to all inks available in a printer as described above, the correction is not always satisfactory to all inks. This may cause single-color characters and drawings to have jaggy contours consequently.

SUMMARY OF THE INVENTION

Accordingly, an object of the present invention is to correct dot misalignment in the main scanning direction caused by bidirectional printing with respect to specific inks.

In order to attain at least part of the above and other related objects of the present invention, there is provided a bidirectional printer. The bidirectional printer is equipped with a plurality of nozzle groups each having a plurality of nozzles that eject ink droplets of identical color. The plurality of nozzle groups includes: a first type nozzle group that is used to eject ink of a first ink group including at least one ink where the first type nozzle group eject ink droplets along both the forward and reverse passes of the main scanning, and a second type nozzle group that is used to eject ink of a second ink group including at least one ink where the second type nozzle group eject ink droplets along only a selected one of the forward and reverse passes of the main scanning. Along the selected one of the forward passes and reverse passes of the main scanning, ink droplets are ejected from the nozzles of the first type nozzle group and nozzles of the second type nozzle group. Ink droplets are ejected only from the nozzles of the first type nozzle group on the other of the forward and reverse passes while the nozzles of the second type nozzle group do not eject ink.

In such a configuration, since printing for the second ink group is performed only on one of the forward and reverse passes of the main scanning, and not on both passes, the problem of dot misalignment caused by bidirectional printing will be relieved for the second ink group.

It is also desirable that the second type nozzle group be able to use a number of nozzles that is $2\times i$ times (i is a natural number) the number of nozzles used in the first type nozzle group. If such a configuration is used, then, when printing is performed on the forward and reverse passes with the first ink group, and printing is performed only on the forward or reverse passes (but not both) with the second ink group, it is possible to use a number of nozzles for the second ink group on the forward passes or reverse passes alone that is an integral multiple of the number of nozzles used in the bidirectional printing of the first ink group.

It is desirable that the above mentioned integer i be 1. In this case, the number of nozzles used in the second type nozzle group is twice the number of nozzles used in the first type nozzle group. If this configuration is used, then the sum total of the number of nozzles used along the forward pass and that along the reverse pass for the first ink group is equal to the number of nozzles used for the second ink group along one of the forward and reverse passes alone.

Furthermore, it is desirable that the plurality of nozzles of the first type nozzle group consist of N nozzles (N is a natural number) installed at a fixed pitch of 2 k along the sub-scanning direction, that the second type nozzle group includes first and second partial nozzle groups, that the plurality of nozzles respectively constituting the first and second partial nozzle groups consists of N nozzles each installed at a fixed pitch of 2 k with respect to the sub-scanning direction, and that the first partial nozzle group is installed in positions that are shifted in the sub-scanning direction by a distance of $2k(m-\frac{1}{2})$ (m is a natural number) from the second partial nozzle group.

This configuration is especially useful when a sub-scanning feed of $2k(m-\frac{1}{2})$ is repeatedly performed between the forward pass and the reverse pass. If recording is performed on either the forward pass or reverse pass for the second ink group, raster lines can be recorded without omission on the same base as the first ink group.

It is also desirable that the integer m be 1 in the second type nozzle group. If such a configuration is adopted, then the two partial nozzle groups for the second ink group are installed in positions that are shifted by a distance of k relative to each other, so that both partial nozzle groups are installed in close proximity in the sub-scanning direction. Accordingly, the size of the printing head can be reduced.

The plurality of nozzles of the first type nozzle group may consist of N nozzles (N is a natural number) installed at a fixed pitch of k along the sub-scanning direction. The second type nozzle group may include first and second partial nozzle groups, each consisting of N nozzles at a fixed pitch of k along the sub-scanning direction. The first partial nozzle group may be installed in positions that are shifted in the sub-scanning direction by a distance of $(j-1)k$ (j is a natural number) from the second partial nozzle group.

When the printing head is in a certain position in the sub-scanning direction, the respective nozzles of the first type nozzle group can record N corresponding raster line with the first ink group. Meanwhile, one of the two partial nozzle groups of the second ink group can record N raster lines, and the other partial nozzle group can record additional N raster lines. Furthermore, the raster lines recorded by this other partial nozzle group are positioned ahead of the raster lines recorded by the first partial nozzle group by a distance equal to (j−1). As a result, before specific raster lines are recorded by one partial nozzle group, preceding raster lines can be recorded beforehand by the other partial nozzle group.

It is desirable that the integer j be (N+1) in the second type nozzle group.

The first ink group may include colored inks, and the second ink group may consist of black ink. If color images are printed with colored inks while characters or tables are simultaneously printed with black ink, the characters or tables will all be printed unidirectionally on the forward or reverse passes of the main scanning. Accordingly, the dot misalignment caused by bidirectional printing will not occur in the characters or tables that are printed with black ink.

The ejection timing of the ink droplets may be corrected on the basis of a specific correction value on at least one of the forward and reverse passes of the main scanning using the first type nozzle group. If such a configuration is adopted, then the quality of the printing results of the first ink group can be improved without affecting the quality of the printing results of the second ink group. Specifically, in regard to the second ink group, the quality of the characters printed with a single ink can be guaranteed by performing unidirectional printing; at the same time, in regard to the first ink group, the quality of the image printed with plural color inks can be improved by performing the dot misalignment correction.

The present invention can be realized in the following configurations.

(1) Bidirectional printer. Printing control device. Printing head.

(2) Printing method. Printing control method.

(3) Computer program for realizing the above mentioned apparatus or method.

(4) Recording medium recording a computer program for realizing the above mentioned apparatus or method.

(5) Data signal embodied in a carrier wave that includes a computer program for realizing the above mentioned apparatus or method.

BRIEF DESCRIPTION OF DRAWINGS

FIG. 6 schematically illustrates the first feeding method of the printing head 28 during printing in the first embodiment;

FIG. 7 schematically illustrates the second feeding method of the printing head 28 during printing in the first embodiment;

FIG. 10 schematically illustrates the first feeding method of the printing head 28 during printing in the second embodiment;

FIG. 11 illustrates how the respective raster lines are recorded in the first feeding method of the second embodiment;

FIG. 12 illustrates the second feeding method of the printing head 28*a* during printing in the second embodiment;

FIG. 13 illustrates how the respective raster lines are recorded in the second feeding method of the second embodiment.

DESCRIPTION OF THE PREFERED EMBODIMENT

Figure 1:
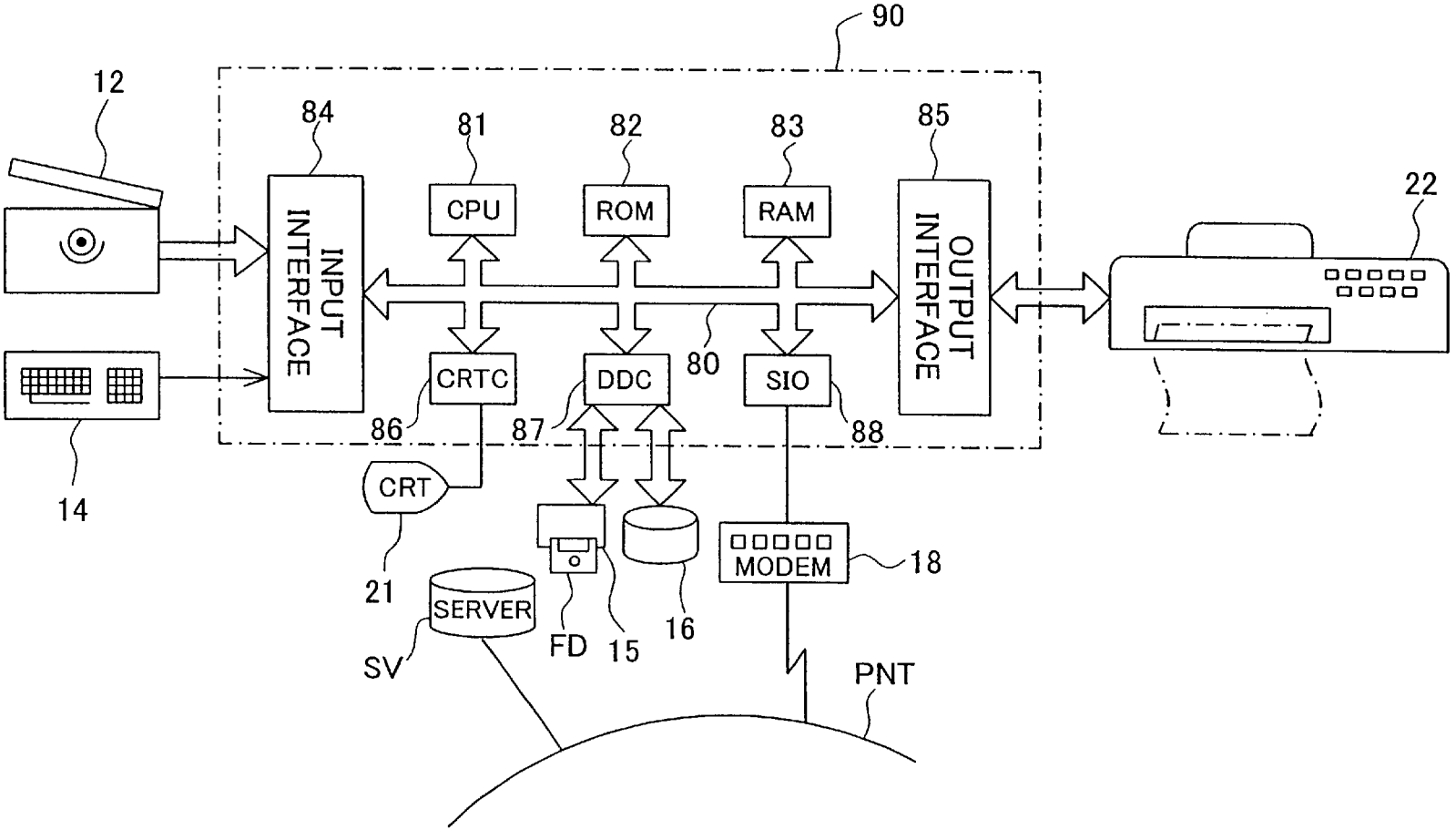
FIG. 1 is a schematic structural diagram of the printing device embodying the present invention.

Working configurations of the present invention will be described in the order shown below:

A. First Embodiment:
- A-1. General configuration of apparatus:
- A-2. Configuration of software:
- A-3. Configuration of printer:
- A-4. Configuration of printing head:
- A-5. Internal Configuration of control circuit:
- A-6. Feeding method:
- A-7. Correction method:

B. Second Embodiment:
- B-1. Configuration of apparatus:
- B-2. Printing method:
- B-3. Correction method:
- B-4. Modification of Second Embodiment:

C. Others:

A. First Embodiment:

A-1. General Configuration of apparatus:

FIG. 1 shows the general configuration of an image processing device and a printer as an embodiment of the present invention. A scanner 12 and a printer 22 are connected to a computer 90. This computer 90 functions as an image processing device as a result of a specified program being loaded and executed. This computer also functions as a printing device together with the printer 22. This computer 90 includes a CPU 81 which performs various types of operational processing in order to control operations for image processing; the computer 90 is also equipped with the respective parts described below, which are connected by a bus 80. The ROM 82 stores in advance various types of programs and data required in order to perform various types of operational processing in the CPU 81. The RAM 83 is a memory for temporarily storing various types of programs and data required in order for the CPU 81 to perform various types of operational processing. The input interface 84 receives signals from the scanner 12 and keyboard 14, while the output interface 85 outputs data to the printer 22. The CRTC 86 controls the signal output to a CRT 21 which displays a color image. The disk controller (DDC) 87 controls the exchange of data between the hard disk 16 and flexible drive 15 or CD-ROM drive (not shown in the figures). Various types of programs that are loaded into the RAM 83 and executed, and various types of programs that are provided in the form of device driver are stored on the hard disk 16.

A serial input-output interface (SIO) 88 is connected to the bus 80. This SIO 88 is connected to a modem 18, and is connected to a public telephone network PNT via this modem 18. The computer 90 is connected to an external network via SIO 88 and modem 18, and is connected to a specified server SV, so that programs necessary for image processing can also be downloaded onto the hard disk 16. Required programs can also be loaded by means of a flexible disk FD or CD-ROM, and can thus be executed by the computer 90.

Figure 2:
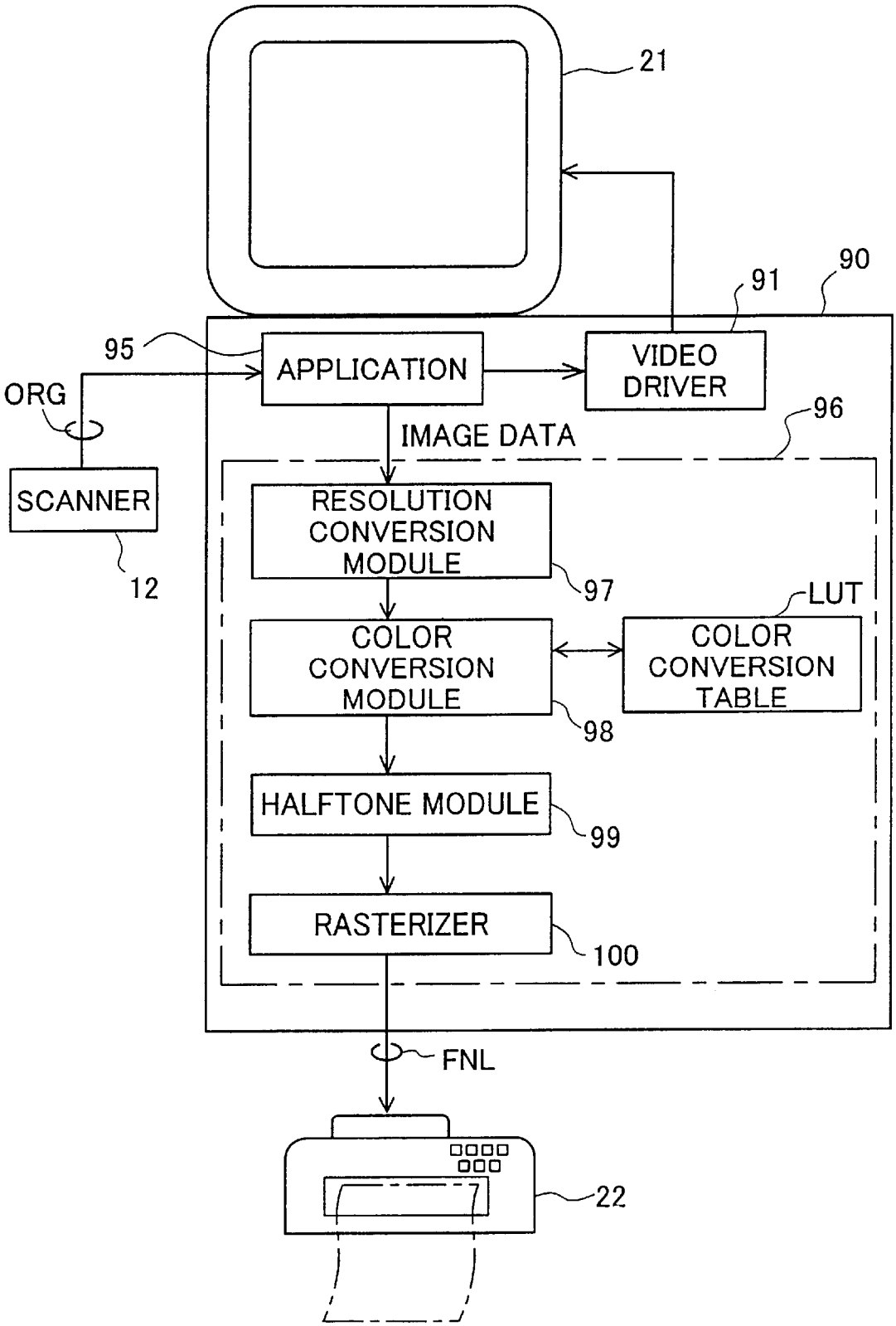
FIG. 2 illustrates the configuration of the software of the printing device.

A-2. Configuration of software:

FIG. 2 is a block diagram which illustrates the configuration of the software of the present printing device. In the computer 90, an application program 95 operates under a specific operating system. A video driver 91 and a printer driver 96 are incorporated in the operating system, and printing data FNL to be transferred to the printer 22 is output from the application program 95 via these drivers. In the case of an application program 95 that performs retouching of images, images are read in from the scanner 12, and the images are displayed on the CRT 21 via the video driver 91 while specific processing is performed on these images. The scanner 12 inputs data ORG read from color originals. The original color data ORG consists of the three color components of red (R), green (G) and blue (B).

When the application program 95 issues a printing command, the printer driver 96 of the computer 90 receives printing data from the application program 95, and converts this data into signals that can be processed by the printer 22 (here, multi-value signals for the respective colors of cyan, magenta, yellow and black). In the example shown in FIG. 2, a resolution conversion module 97, a color conversion module 98, a halftone module 99 and a raster lineizer 100 are installed inside the printer driver 96. A color conversion table LUT is also stored. The color conversion table LUT may be read in from the CD-ROM may be stored in the ROM beforehand.

The resolution conversion module 97 acts to convert the resolution of the color image data handled by the application program 95, that is the number of pixels per unit length, into a resolution suitable for the printer driver 96. The resolution converted data includes image information consisting of the three colors R, G and B. Accordingly, the color conversion module 98 converts this information into data of the respective colors of cyan (C), magenta (M), yellow (Y) and black (K), which are used by the printer 22, for each pixel while referring to the color conversion table LUT.

The color-converted data has tone values over a range of 256 levels, for example. The halftone module 99 performs halftone processing to produce printing data for reproducing these tones with the printer 22 by forming dispersed ink dots. The printing data thus processed is lined up by the raster lineizer 100 in a data sequence that is to be transferred to the printer 22, and is output as final printing data FNL. Specifically, in the raster lineizer 100, the printing data is lined up in the data sequence that is to be transferred to the printer 22 according to the allocation of the nozzles to respective raster lines. The printing data FNL includes raster line data that indicates the recording states of the dots during each main scanning, and sub-scan feed data that indicates sub-scan feed amounts. In the present embodiment, the printer 22 merely acts to form ink dots in accordance with the printing data FNL, and does not perform image processing. However, it would also be possible to perform the image processing within the printer 22. The timing of ejecting ink for each nozzle is determined in the printer; but this processing can be performed in the printer driver 96.

Figure 3:
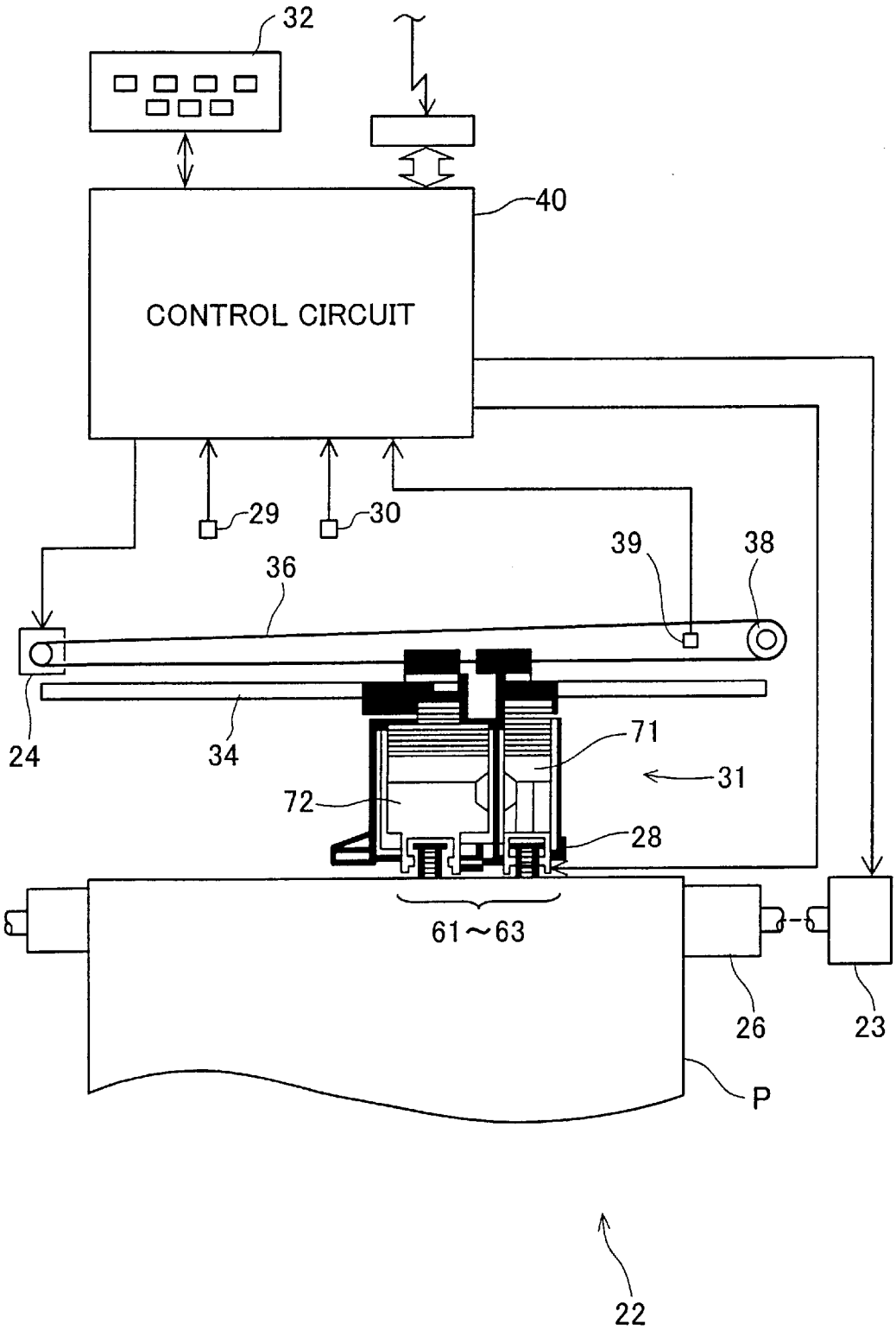
FIG. 3 schematically illustrates the structure of the printer.

A-3. Configuration of printer:

FIG. 3 shows the configuration of the printer 22. The printer 22 is constructed from a sub-scanning mechanism which transports the paper P by means of a paper feeding motor 23, a main scanning mechanism which moves the carriage 31 in a reciprocating motion along the axial direction of the platen 26 by means of a carriage motor 24, a head driving mechanism which causes the ejection of ink and the formation of ink dots by driving a printing head 28 mounted on the carriage 31, and a control circuit 40 which controls the exchange of signals between the above mentioned paper feeding motor 23, carriage motor 24 and printing head 28, and an operating panel 32.

The main scanning mechanism is provided with a sliding shaft 34 that holds the carriage 31 so that the carriage 31 is free to slide, a pulley 38 which mounts an endless driving belt 36 between the pulley itself and the carriage motor 24, and a position detection sensor 39 which detects the origin position of the carriage 31.

A black ink cartridge 71 and a colored ink cartridge 72 that accommodates inks of the three colors cyan, magenta and yellow are mounted in the carriage 31. Three actuators 61 through 63 are formed in the printing head 28 on the lower part of the carriage 31, and introduction tubes that introduce ink from ink tanks into heads for these respective colors are disposed in vertical positions on the bottom part of the carriage 31. When the black ink cartridge 71 and colored ink cartridge 72 are mounted on the carriage 31 from above, the introduction tubes are inserted into connection holes formed in the respective cartridges, so that ink can be supplied to the actuators 61 through 63 from the respective ink cartridges.

Figure 4:
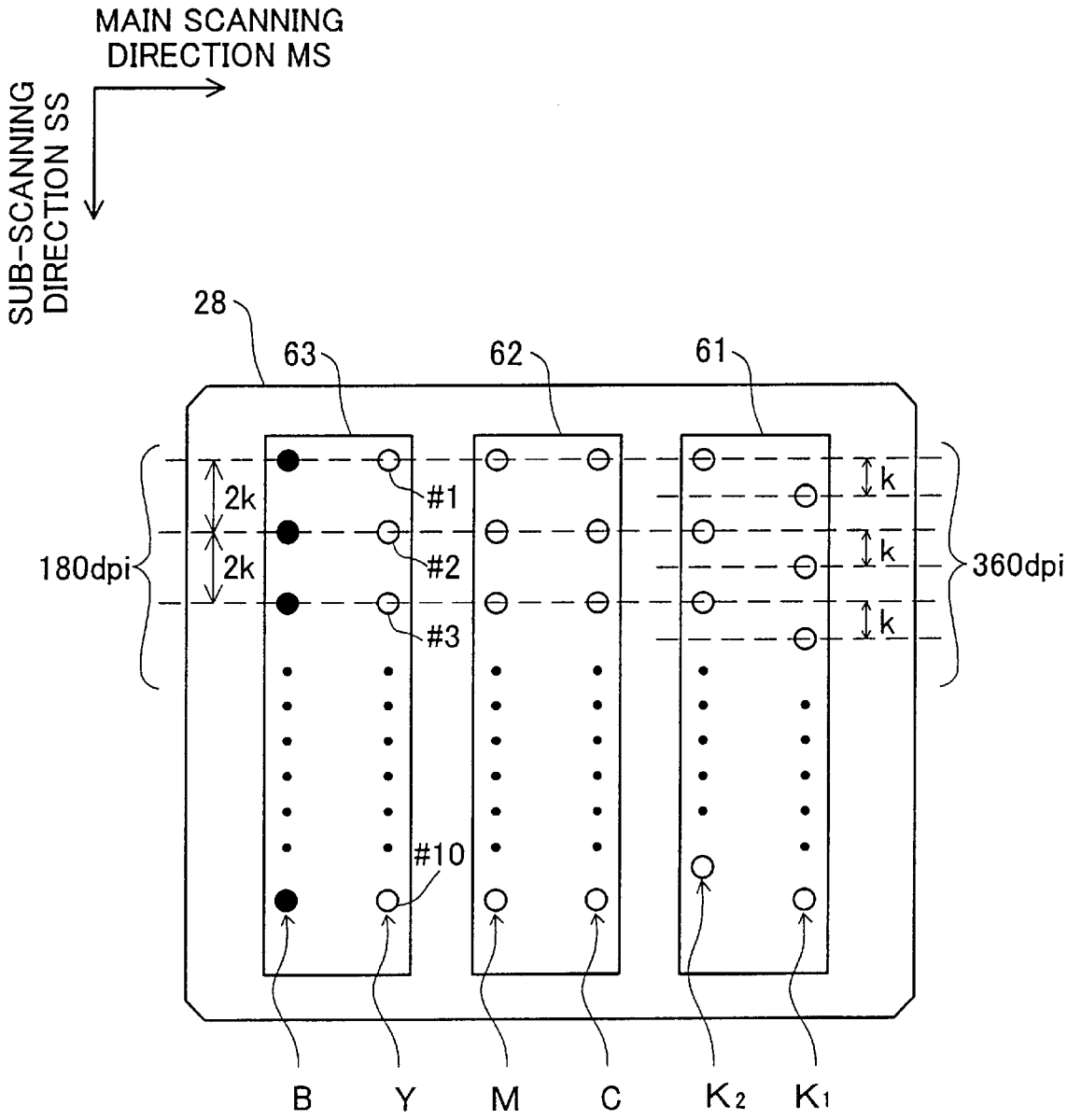
FIG. 4 is a plan view which illustrates the disposition of the nozzles on the bottom face of the printing head 28.

A-4. Configuration of printing head:

FIG. 4 is a plain view which shows the disposition of the nozzles on the printing head 28. The printing head 28 has three actuators 61 through 63. As is shown in FIG. 4, two nozzle rows that are oriented in the sub-scanning direction SS are disposed on each of the three actuators 61 through 63. The nozzles that constitute the respective nozzle rows consist of 10 nozzles installed at a uniform pitch of 2 k. Each of these 10 nozzles ejects ink droplets of identical color. Nozzle rows $K_1$ and $K_2$ are installed on the first actuator 61. They both eject black ink. Each of the nozzle rows $K_1$ and $K_2$ consists of 10 nozzles installed at a uniform pitch of 2 k, and the nozzle row $K_1$ is shifted by a distance of k in the sub-scanning direction SS with respect to the nozzle row $K_2$. Nozzle rows M and C are installed on the second actuator 62. The nozzle row M ejects magenta ink, while the nozzle row C ejects cyan ink. The nozzle rows M and C are installed in positions which are such that the respective nozzles that constitute these rows are aligned in the main scanning direction MS with the respective nozzles that constitute the nozzle row $K_1$. Furthermore, nozzle rows Y and B are installed on the third actuator 3. The nozzle row Y ejects yellow ink. In this embodiment, the nozzle row B is a dummy nozzle row that is not used. The nozzle rows Y and B are also installed in positions which are such that the respective nozzles that constitute these nozzle rows are aligned in the main scanning direction MS with the respective nozzles that constitute the nozzle row $K_1$. The nozzles that are not used are shown with shaded circles in FIG. 4.

The nozzle rows Y, M and C are constructed from nozzles that are lined up at a uniform pitch of 2 k in the sub-scanning direction SS. The pitch of these nozzles in the sub-scanning direction SS is 180 dpi. Accordingly, for the respective colors of yellow, magenta and cyan, dots can be formed on the printing medium at a maximum resolution of 180 dpi with respect to the sub-scanning direction SS by a single main scanning.

Similarly, in the case of the nozzle rows $K_1$ and $K_2$, both of which eject black ink, the nozzle rows are constructed from nozzles that are lined up at a uniform pitch of 2 k in the sub-scanning direction SS; however, the nozzle row $K_1$ is shifted by a distance of k relative to the nozzle row $K_2$. As a result, for black ink, if the nozzle rows $K_1$ and $K_2$ are simultaneously used in one main scanning, dots can be formed on the printing medium at a maximum resolution of 360 dpi in the sub-scanning direction SS.

A piezo-electric element, which is a type of electrostriction element and which is superior in terms of response characteristics, is installed in each of the nozzles. This piezo-electric element is installed in a position that is adjacent to the ink passage that introduces ink into the nozzle. As is well known in the art, piezo-electric elements have a crystal structure that is distorted by the application of a voltage, so that electrical energy is converted into mechanical energy at an extremely high speed. In the present embodiment, a voltage is applied for a specified period of time across electrodes installed on both ends of each piezo-electric element; as a result, the piezo-electric elements expand while the voltage is being applied, and deform one side wall of each ink passage. Consequently, the volume of the ink passage contracts in response to the expansion of the piezo-electric element, so that an amount of ink corresponding to the amount of this contraction is ejected as ink droplets at a high velocity from the tip end of the nozzle. Printing is performed as a result of these ink droplets soaking into the paper P that is mounted on the platen 26.

Figure 5:
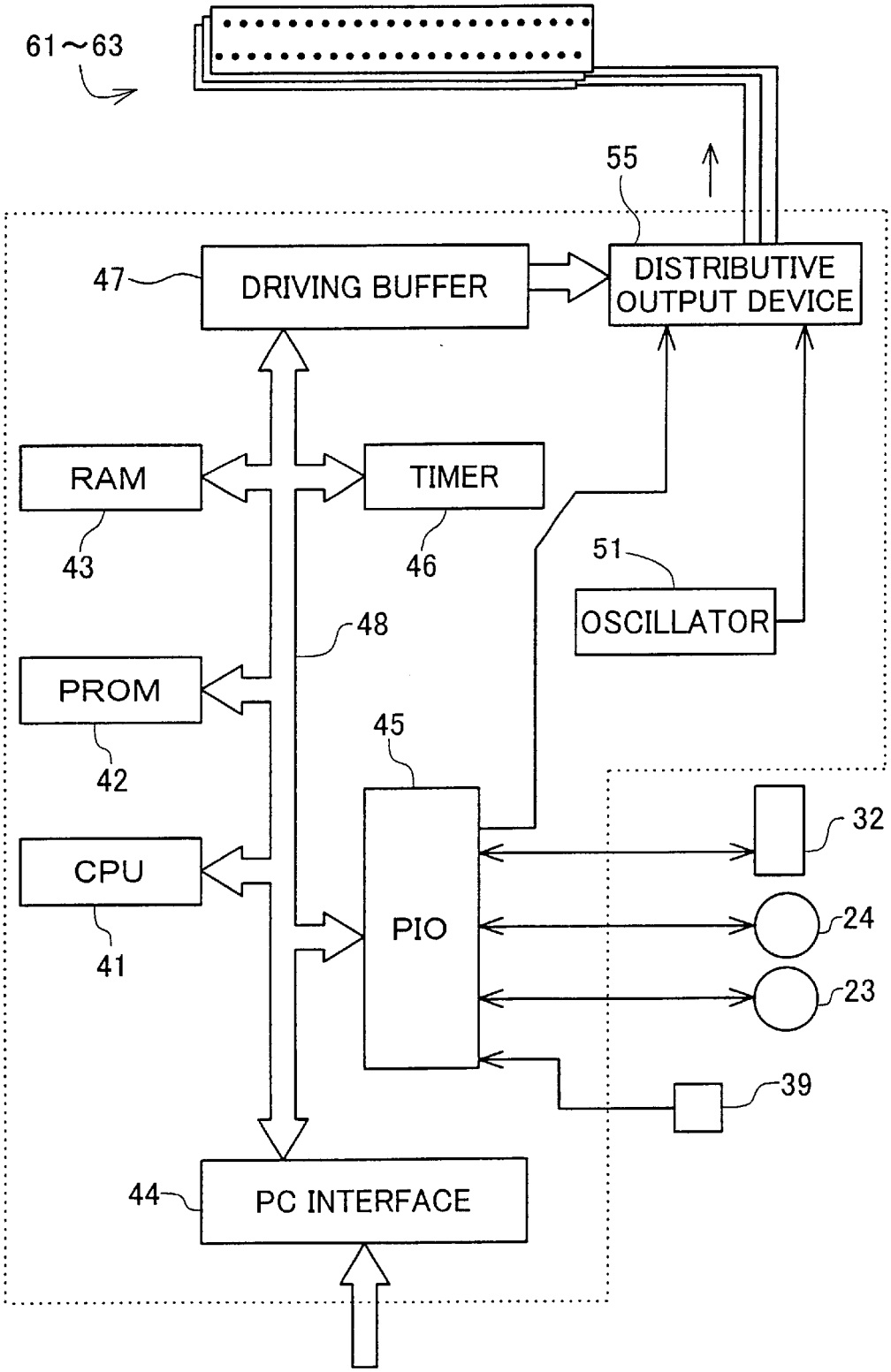
FIG. 5 illustrates the internal configuration of the control device of the printer.

A-5. Internal Configuration of control circuit:

FIG. 5 illustrates the internal configuration of the control circuit 40. The control circuit 40 is provided, in addition to CPU 41, PROM 42 and RAM 43, with: a PC interface 44 which exchanges data with the computer 90; a peripheral input-output part (PIO) 45 which handles the exchange of signals between the paper feeding motor 23, carriage motor 24 and operating panel 32; a timer 46 which performs a clock function; and a driving buffer 47 which outputs ON and OFF signals for the ink dots to the actuators 61 through 63. These elements and circuits are connected to each other by a bus 48. There is also provided an oscillator 51 which outputs a driving waveform as a voltage signal that is used to drive the piezo-electric elements at a specified frequency, and a distributive output device 55 which distributes the output from the oscillator 51 to the actuators 61 through 63 at a specified timing. The control circuit 40 receives dot data or raster line data that has been processed by the computer 90, temporarily stores this data in the RAM 43, and then outputs this data to the driving buffer 47 at a specified timing. The CPU 41 determines the timing at which the respective nozzles are to be driven on the basis of the above mentioned dot data. For example, determinations that specified nozzles are not to be driven during the reverse pass of the main scanning is made at this point in time.

The on-off switching signals are output to the respective terminals of the driving buffer 47, and only the piezo-electric elements that have received "on" signals from the driving buffer 47 are driven in accordance with the signal that is supplied to the piezo-electric elements. As a result, ink droplets are simultaneously ejected from the nozzles of the piezo-electric elements that have received "on" signals from the driving buffer 47. In other words, a common signal that is used to drive the piezo-electric elements are supplied to the piezo-electric elements of all of the nozzles regardless of whether or not these nozzles are to form ink dots; however, the effective/ineffective status of the common driving signal is controlled for each nozzle by the on-off switching signals that are supplied from the driving buffer 47 for each nozzle.

The printer 22 feeds the paper P by means of the paper feeding motor 23, and causes the carriage 31 to perform a reciprocating motion by means of the carriage motor 24. At the same time, the piezo-electric elements of the actuators 61 through 63 of the printing head 28 are driven so that ink droplets of respective colors are ejected, thus forming ink dots so that a multi-color multi-tone image is formed on the paper P.

A-6. Feeding method:

(1) First feeding method (band feed/band feed):

FIG. 6 schematically illustrates the first feeding method of the printing head 28 during printing in the first embodiment. In the first embodiment, printing is performed using all of the nozzles on the forward passes of the main scanning. However, the nozzle rows $K_1$ and $K_2$ are not used on the reverse passes; instead, only the nozzle rows C, M and Y are used. Here, the expression "nozzles are not used on the reverse passes" refers to the fact that the nozzles are not used even once along the reverse passes in one page of the printing medium. All other cases are included in the expression "nozzles are used".

In the first embodiment, printing is performed at 360 dpi in the sub-scanning direction. In other words, the density of the raster lines on the printing medium is 360 dpi. Here, the term "raster line" refers to a hypothetically determined "line" (extending in the main scanning direction) which indicates the positions in which dots are formed on the printing medium. The pitch of the raster lines is k, which is a half the nozzle pitch of 2 k.

On the forward passes on which all of the nozzles are used, dots can be formed for black in all of the raster lines at 360 dpi by means of the nozzle rows $K_1$ and $K_2$. However, for cyan, magenta and yellow, dots can only be formed in every other raster line at a density of 180 dpi. For example, in the case of pass 1 (forward pass), as is shown in the upper left part of FIG. 6, black dots can be formed on raster lines 1 through 20. However, in the case of cyan, magenta and yellow, dots can only be formed in every other raster line, i.e., 1, 3, 5, . . . 19. Here, the "pass number" is counted as follows: the first forward pass of the main scanning is the first pass, the reverse pass in this case is the second pass, and the next forward pass is the third pass, etc. The numbers noted in the columns on the left side of FIG. 6 are those of the nozzles used to record the raster lines in question. As is shown in FIG. 4, the respective nozzles are numbered as #1, #2 and so on from the upstream side in the sub-scanning direction.

When one forward pass of the main scanning is completed, the control circuit 40 feeds the printing head 28 in the sub-scanning direction by a distance of k. Then, the reverse pass (second pass) of the main scanning is performed. In the first embodiment, the nozzle rows $K_1$ and $K_2$ are not used on the reverse passes; in this case, only the nozzle rows C, M and Y are used. Accordingly, in the case of cyan, magenta and yellow, which are printed leaving every other raster line blank on the forward passes, dots are formed in the blank raster lines as a result of the formation of dots on the reverse passes. For example, as is shown in the upper left part of FIG. 6, in the case of pass 2 (reverse pass), dots are formed in every other raster line, i.e., 2, 4, 6, . . . 20, for cyan, magenta and yellow. As a result, dots can be formed in all of the raster lines 1 through 20 for cyan, magenta and yellow. Specifically, in the case of cyan, magenta and yellow, all of the raster lines 1 through 20 can be filled in by two passes on the forward and reverse passes. Meanwhile, in the case of black, all of the raster lines 1 through 20 can be filled in on a single forward pass alone.

When a pair of the forward and reverse passes of the main scanning are completed, the control circuit 40 feeds the printing head 28 in the sub-scanning direction by a distance of 19 k. Subsequently, the forward pass of the main scanning (third pass) is again executed. As a result of the printing head 28 being fed in the sub-scanning direction by a distance of 19 k, the first nozzle of each of the nozzle rows C, M, Y, $K_1$ and $K_2$ is positioned at raster line 21. On the forward and reverse passes of the initial main scanning, all of the raster lines 1 through 20 are recorded; then, on the next forward pass and reverse pass, the raster lines 21 through 40 are recorded. Then, similarly, when the forward pass of the main scanning is completed, the control circuit 40 performs a sub-scanning feed of k prior to the execution of the next reverse pass, and when the reverse pass of the main scanning is completed, the control circuit 40 performs a sub-scanning feed of 19 k prior to the execution of the next forward pass. Then, as a result of one forward pass and one reverse pass of the main scanning, 20 consecutive raster lines corresponding to the total number of nozzles in the nozzle rows $K_1$ and $K_2$ are recorded.

The right-hand portion of FIG. 6 indicates whether each raster line is recorded on the forward pass or reverse pass, and indicates the number of the nozzle in each nozzle row by which each raster line is recorded. In the table on the right-hand side of FIG. 6, raster lines for which "Fwd." is noted in the columns are recorded on the forward passes, while raster lines for which "Rev." is noted are recorded on the reverse passes. The numerals shown beside the notations of "Fwd." or "Rev." indicate the number of the nozzle in each nozzle row by which the raster line is recorded. As is clear from FIG. 6, raster lines that are recorded on the forward passes and raster lines that are recorded on the reverse passes are alternately arranged with respect to the colored inks (cyan, magenta and yellow). Meanwhile, with respect to black ink, all of the raster lines are recorded on the forward passes. As a result, the dot misalignment caused by bidirectional printing does not occur in the black dots, and even in cases where straight lines are drawn in the sub-scanning direction, these lines can be drawn completely straight.

In this printing method, a band of 20 consecutive raster lines are all recorded before the printing process proceeds to the next band of 20 consecutive raster lines, with respect to both the colored inks (cyan, magenta and yellow) and black ink. Such a "method of sub-scan feed in which all of the raster lines in a band of consecutive raster lines are recorded before the printing head 28 is moved by an amount corresponding to the number of raster lines contained in the band of raster lines" will be referred to below as "band feed". A feeding method in which printing is performed by such a band feed with respect to both the colored inks and black ink will be referred to below as "band feed/band feed". The first half of this designation indicates the feeding method used for the colored inks, while the second half of the designation indicates the feeding method used for the black ink. The black ink nozzles in this embodiment record adjacent raster lines without gaps in a single pass, consequently "band feed" must be used with respect to the black ink.

On the other hand, with respect to the colored inks (cyan, magenta, yellow), raster lines can be recorded according to "interlaced feed". The interlaced feed denotes a method in which dots are recorded in every other raster line or in one out of every several raster lines in a new target region of printing while filling the missing raster lines in the gaps between previously recorded raster lines." Furthermore, a printing method utilizing the interlaced feed for colored inks and the band feed for black ink will be referred to as "interlaced feed/band feed". This "interlaced feed/band feed" feeding method will be described below.

(2) Second feeding method "interlaced fee/band feed":

FIG. 7 schematically illustrates the second feeding method of the printing head 28 during printing in the first embodiment. In this feeding method, when the forward pass of the main scanning is completed, the control circuit 40 performs a sub-scanning feed of 9 k before executing the next reverse pass, and when the reverse pass of the main scanning is completed, the control circuit 40 performs a sub-scanning feed of 11 k prior to the next forward pass. In all other respects, this method is similar to that described in the above mentioned first feeding method "band feed/band feed".

In this feeding method, as is shown in FIG. 7, for the colored inks, raster lines 1, 3, 5 . . . 19 are recorded in the first pass (forward pass), and raster lines 10, 12, 14 . . . 28 are recorded in the second pass (reverse pass). Recording is performed with the raster lines 10, 12, 14, 16, 18 and 20 filled in between the already recorded raster lines 9, 11, 13, 15, 17 and 19. Raster lines 22, 24, 26 and 28 are newly recorded with a gap of one raster line left between these raster line. The raster lines 21, 23, 25, 27 and 29 which form the gaps between the raster lines 22, 24, 26 and 28 are then recorded in the third pass (forward pass). Since the raster line 20 recorded in the second pass (reverse pass) and the raster line 29 recorded in the third pass (forward pass) are positioned at the ends of the recorded raster lines, these raster lines cannot be strictly referred to as "gap raster lines" or "space raster lines"; however, in order to simplify the description, these raster lines will also be treated as "gap raster lines" or "space raster lines".

In this feeding method, with respect to black ink, 20 consecutive raster line are printed in two passes (forward pass and reverse pass) of the main scanning in the same manner as in the first feeding method.

On the right-hand side of FIG. 7, it is indicated whether the respective raster lines are recorded on the forward pass or reverse pass, and the nozzles of the respective nozzle rows used to record each raster line are also indicated. In the case of colored inks (cyan, magenta, yellow), as is clear from FIG. 7, raster lines recorded on the forward passes and raster lines recorded on the reverse passes are alternately arranged. Meanwhile, in the case of black, all of the raster lines are recorded on the forward passes. As a result, in this feeding method as well, the dot misalignment caused by bidirectional printing does not occur with respect to black ink, and even in cases where straight lines are drawn in the sub-scanning direction, these lines can be drawn completely straight. In cases where a band feed is used, a seam may appear between respective bands of raster lines that are consecutively printed with a small sub-scanning feed; in this second feeding method, on the other hand, since an interlaced feed is used for the colored inks, such a problem will be relieved. In the printing head of this first embodiment, as is described above, a high printing quality of characters and tables with black ink and a high color image quality can be obtained on the same page by appropriately selecting the feeding method.

A-7. Correction method:

The control circuit 40 causes the ejection of ink droplets from the nozzle rows C, M and Y on the reverse passes of the main scanning. In this process, the control circuit 40 performs the dot misalignment correction by advancing or retarding the ejection timing of the ink droplets, thus reducing the dot misalignment that arises from the fact that the scanning direction is reversed on the forward and reverse passes. Specifically, ejection timing of the ink droplets on the forward and reverse passes is intentionally shifted on all of the reverse passes so that deviation of the recording positions of the dots on the forward and reverse passes is made less noticeable.

Figure 8A:
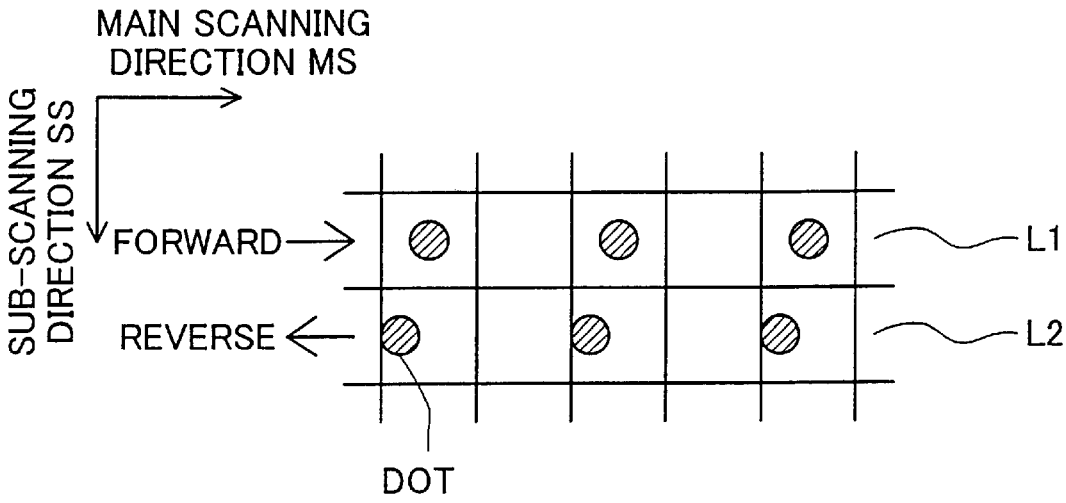
FIG. 8A illustrates the dot misalignment in the main scanning direction that occurs during bidirectional printing.

FIG. 8A illustrates the dot misalignment in the main scanning direction that occurs in the case of bidirectional printing. The grid in FIG. 8A illustrates the boundaries of the pixel areas; one rectangular region marked off by this grid corresponds to the area of a single pixel. When the printing head (not shown in the figures) moves along the main scanning direction, a dot is recorded in each pixel by ink droplets that are ejected from the printing head. In the example shown in FIG. 8A, raster line L1 is recorded on the forward pass of the main scanning, and raster line L2 is recorded on the reverse pass. On the forward pass, the ink droplets are ejected at a timing which is such that the droplets stroke the centers of the pixels. Accordingly, on the reverse pass, since the printing head moves in the opposite direction from the direction of travel of the printing head on the forward pass, a momentum that is oriented in the "forward scanning direction of the head" is imparted to the ink droplets, so that the ink droplets strike to the left of the centers of the pixels as shown in raster line L2. Accordingly, in the case of such ink droplets, dots are formed in different positions in the main scanning direction depending on whether the ink droplets are ejected on the forward pass or reverse pass, even in cases where the ink droplets are aimed at the same pixels when ejected.

Figure 8B:
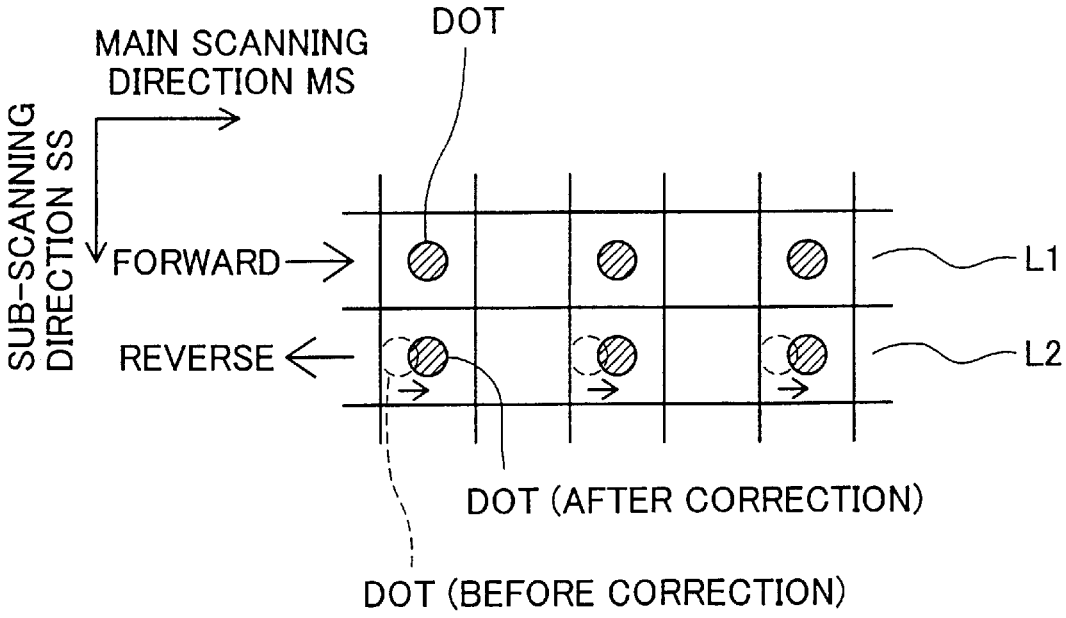
FIG. 8B illustrates the method of correcting the dot misalignment.

FIG. 8B illustrates the method of correcting the dot misaligninent in the main scanning direction that occurs in the case of bidirectional printing. In order to eliminate the above mentioned deviation in the striking positions that occurs in the case of bidirectional printing, the control circuit 40 shifts the overall ejection timing of the ink droplets on the reverse passes as shown in FIG. 8B, and thus shifts all of the striking positions on the reverse passes so that the striking positions are aligned on the forward and reverse passes. In the example shown in FIG. 8B, the striking positions are shifted to the left on the forward passes, and the striking positions are shifted to right on the reverse passes, so that the striking positions of the ink droplets coincide with respect to the main scanning direction on the forward and reverse passes.

If the ejection timing of the ink droplets of the colored inks (cyan, magenta and yellow) are corrected by this correction method, then the quality of color images can be improved without lowering the black printing quality. Specifically, the black printing quality can be maintained by appropriately selecting the feeding method of the printing head so that printing is performed only on the forward passes with respect to black ink. At the same time, the quality of color images is improved by correcting the ejection timing as described above for the colored inks (cyan, magenta and yellow).

In regard to the amount of this ejection timing correction, numerical values that are common to the nozzle rows C, M and Y are used. These numerical values are stored in the PROM 42 (FIG. 5). The correction amount can be determined on the basis of the deviation in the striking positions of the ink droplets of the cyan and magenta inks. The reason for this is that the dot misalignment of cyan and magenta tend to importantly affect the quality of the printing results. In the case of yellow, on the other hand, the dot misalignment tends not to be noticeable; accordingly, there is little need to consider its dot misalignment. Meanwhile, in the case of black, bidirectional printing is not performed; accordingly, there is no need to consider black ink in the dot misalignment correction. In this first embodiment, the correction of the ejection timing of the ink droplets was performed on the reverse passes of the main scanning; however, it would also be possible to perform this correction on the forward passes, or to perform such a correction on both the forward and reverse passes.

B. Second Embodiment

Figure 9:
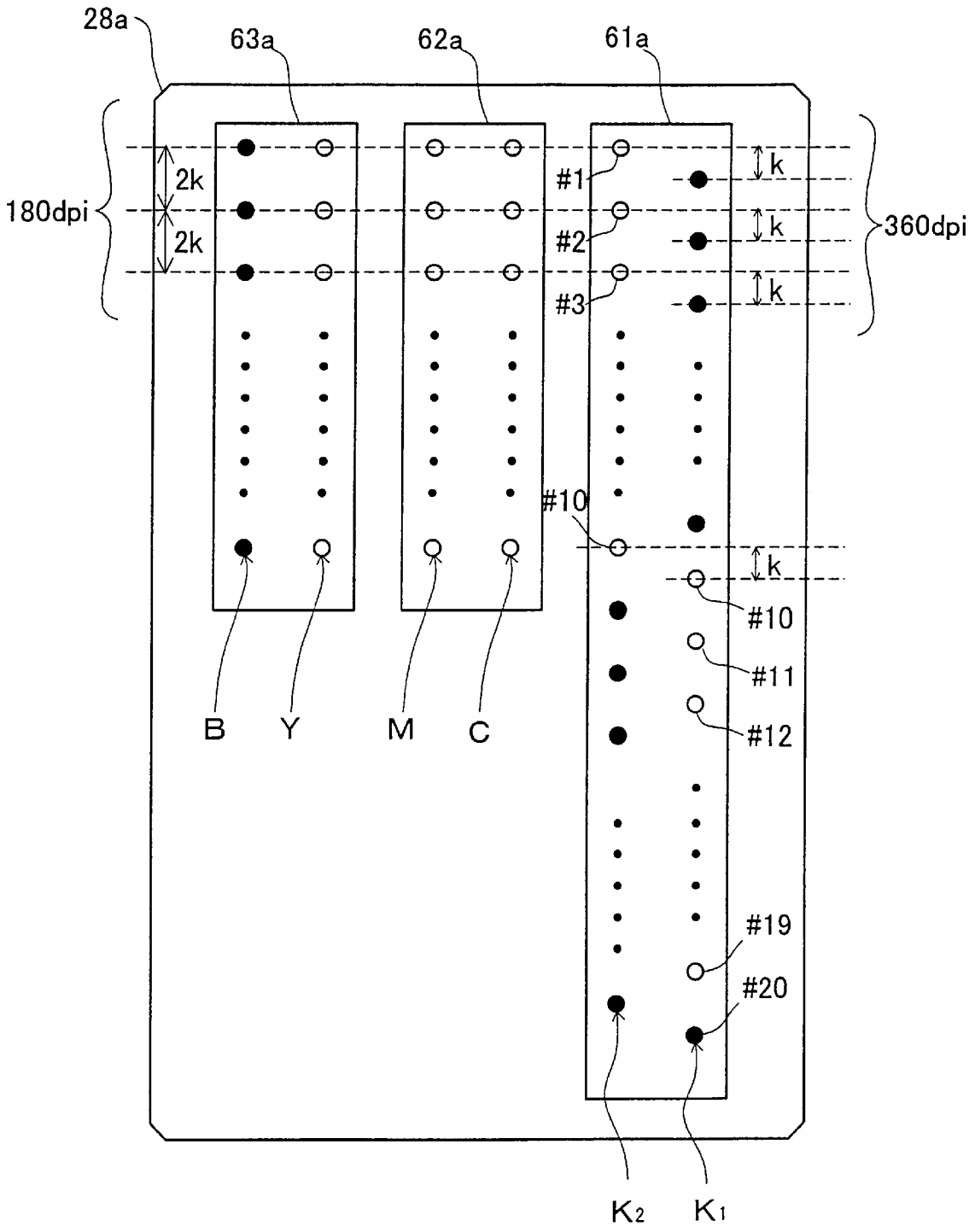
FIG. 9 is a plan view which illustrates the disposition of the nozzles on the printing head 28*a* in the second embodiment.

B-1. Configuration of apparatus:

FIG. 9 is a plan view which illustrates the disposition of the nozzles on the printing head 28*a* of the second embodiment. The printer of the second embodiment differs from the first embodiment in the disposition of the nozzles on the printing head 28*a*. In all other respects, this embodiment is similar to the first embodiment.

As is shown in FIG. 9, two nozzle rows that extend in the sub-scanning direction SS are installed at a uniform pitch of 2 k on each of the actuators 61*a* through 63*a*. The constructions of the second actuator 62*a* and third actuator 63*a* are the same as those of the second actuator 62 and third actuator 63 in the first embodiment. However, the construction of the first actuator 61 a differs from that of the first actuator 61 in the first embodiment, in that 20 nozzles are installed in each of the nozzle rows $K_1$ and $K_2$. Furthermore, as in the first embodiment, the nozzle row $K_1$ is installed in positions that are shifted by a distance of k in the sub-scanning direction SS with respect to the nozzle row $K_2$.

The first through ninth nozzles and the twentieth nozzle of the nozzle row $K_1$ are not used. Furthermore, the eleventh through twentieth nozzles of the nozzle row $K_2$ are not used. As a result, in the nozzle row $K_1$ only the tenth through nineteenth nozzles are used, and in the nozzle row $K_2$, only the first through tenth nozzles are used. When the nozzle rows $K_1$ and $K_2$ are referred to below, this will be understood as a reference only to the nozzles that are used. Meanwhile, as in the first embodiment, the respective nozzles making up the nozzle rows M, C, B and Y are installed in positions which are such that these nozzles are aligned with the first through tenth nozzles of the nozzle row $K_1$ in the main scanning direction MS.

B-2. Printing method:

(1) First feeding method "band feed/interlaced feed":

FIG. 10 schematically illustrates the first feeding method of the printing head 28 during printing in the second embodiment. In this feeding method, feeding similar to that of the first feeding method "band feed/band feed" of the first embodiment is performed. Specifically, when the forward pass of the main scanning is completed, the control circuit 40 performs a sub-scanning feed of k prior to the next reverse pass, and when the reverse pass of the main scanning is completed, the control circuit 40 performs a sub-scanning feed of 19 k prior to the next forward pass. In all other respects, this feeding method is similar to the first feeding method "band feed/band feed" of the above mentioned first embodiment.

In this feeding method, as is shown in FIG. 10, raster lines are recorded in the same manner as in the first feeding method "band feed/band feed" of the first embodiment with respect to colored inks. Meanwhile, with respect to black ink, raster lines 1, 3, 5 . . . 19 and 20, 22, 24 . . . 38 are recorded in the first pass (forward pass), and raster lines 21, 23, 35 . . . 39 and 40, 42, 44 . . . 58 are recorded in the third pass (forward pass). Raster lines 21, 23, 25 . . . 39 are recorded so that they fill in the spaces between the already recorded raster lines 20, 22, 24 . . . 38. Raster lines 40, 42, 44 . . . 58 are newly recorded with one raster line left blank between the respective raster lines. The raster lines 41, 43, 45 . . . 59 that constitute the gaps between these raster lines 40, 42, 44 . . . 58 are recorded in the fifth pass (forward pass).

FIG. 11 illustrates how the respective raster lines are recorded in the first feeding method of the second embodiment. The initial numerical values in the columns indicate the pass in which the respective raster lines are recorded. The label "Fwd." indicates that the raster line is recorded on the forward pass, while "Rev." indicates that the raster line is recorded on the reverse pass. The numerical values following "Fwd." or "Rev." indicate which nozzle of each nozzle row was used to record the raster line. In FIG. 11, in order to facilitate understanding, the information is shown in different columns for each pass.

With respect to the colored inks (cyan, magenta and yellow), as is seen from FIG. 11, raster lines recorded on the forward passes and raster lines recorded on the reverse passes are alternately arranged. Meanwhile, with respect to black ink, all of the raster lines are recorded on the forward passes. As a result, in the case of this feeding method as well, the dot misalignment caused by bidirectional printing does not occur with respect to black ink, and even in cases where straight lines are drawn in the sub-scanning direction, these lines can be drawn completely straight. Furthermore, if this printing method is used, interlaced feeding can be performed for black ink. Accordingly, while the printing quality with black ink can be maintained by performing unidirectional printing, the problem of seam formation between adjacent bands of consecutively printed raster lines that is encountered in the case of band feeding is also avoided. In the printing head 28*a* that is used in the present embodiment, the pitch of the black nozzles that perform unidirectional printing is also made wider than the spacing k of the raster lines; as a result, interlaced feeding is possible for black ink as well.

(2) Second feeding method "interlaced feed/interlaced feed":

FIG. 12 illustrates the second feeding method of the printing head 28*a* during printing in the second embodiment. In this feeding method, when the forward pass of the main scanning is completed, the control circuit 40 performs a sub-scanning feed of 5 k prior to the next reverse pass, and when the reverse pass of the main scanning is completed, the control circuit 40 performs a sub-scanning feed of 5 k prior to the next forward pass. In all other respects, this feeding method is similar to the first feeding method "band feed/band feed" in the second embodiment. In this feeding method, one raster line is printed by two nozzles. Specifically, in each raster line, dots are recorded in every other pixel in one pass, and the remaining pixels are recorded in another pass. As a result, a dot is formed by the same nozzle at every other pixel on each raster line. This printing method is referred to as "overlap printing".

In this overlap printing method, in the case of colored inks (as is shown in FIG. 12), raster lines 1, 3, 5 . . . 19 are recorded in the first pass (forward pass), and raster lines 6, 8, 10 . . . 24 are recorded in the second pass (reverse pass). The raster lines 6, 8, 10 . . . 20 are recorded so that they fill the spaces between the already recorded raster lines 5, 7, 9 . . . 19. The raster lines 22 and 24 are newly recorded with one raster line left blank between the respective raster lines. The raster lines 21, 23 and 25 that constitute the gaps between the raster lines 22 and 24 are recorded for the first time in the fifth pass (forward pass). The raster lines 11, 13, 15 . . . 29 are recorded in the third pass. The raster lines 11, 13, 15, 17 and 19 were already recorded in the fist pass, and are therefore recorded for the second time here. As a result of this second recording pass, all of the pixels of the raster lines 11, 13, 15, 17 and 19 are recorded. Then, the raster lines 27 and 29 are newly recorded with one raster line left blank between the respective raster lines. Printing is then subsequently repeated in the same manner.

FIG. 13 illustrates how the respective raster lines are recorded in the second feeding method of the second embodiment. In the case of colored inks (cyan, magenta and yellow), as is seen from FIG. 13, raster lines recorded on two forward passes and raster lines recorded on two reverse passes are alternately arranged. Meanwhile, in the case of black, all of the raster lines are recorded on two forward passes. As a result, in the case of this feeding method as well, the dot misalignment caused by bidirectional printing does not occur with respect to black ink, and even in cases where straight lines are drawn in the sub-scanning direction, these lines can be drawn completely straight. Furthermore, since interlaced feeding is performed for both colored inks and black ink, the problem of seam formation between adjacent bands of consecutively printed raster lines that is encountered in the case of band feeding does not arise in either black or colored inks. Since overlap printing is performed for all of the raster lines and one raster line is printed by a plurality of nozzles, even in cases where there is a bias in the ink droplet striking position in individual nozzles of the printing head, this bias is not conspicuously reflected in one raster line. In the printing head of the second embodiment, as is described above, the nozzles are installed at a pitch that is wider than the pitch k of the raster lines; accordingly, various types of feeding can be used in order to improve the quality of the printing results.

B-3. Correction method:

In the present embodiment as well, the ejection timing of the ink droplets is corrected in the case of color bidirectional printing. The method used is similar to that used in the case of the first embodiment. If the ejection timing of the ink droplets on the reverse passes is appropriately adjusted, then, in the second embodiment as well, the quality of color images can be improved while maintaining the printing quality of black characters and tables.

Figure 14:
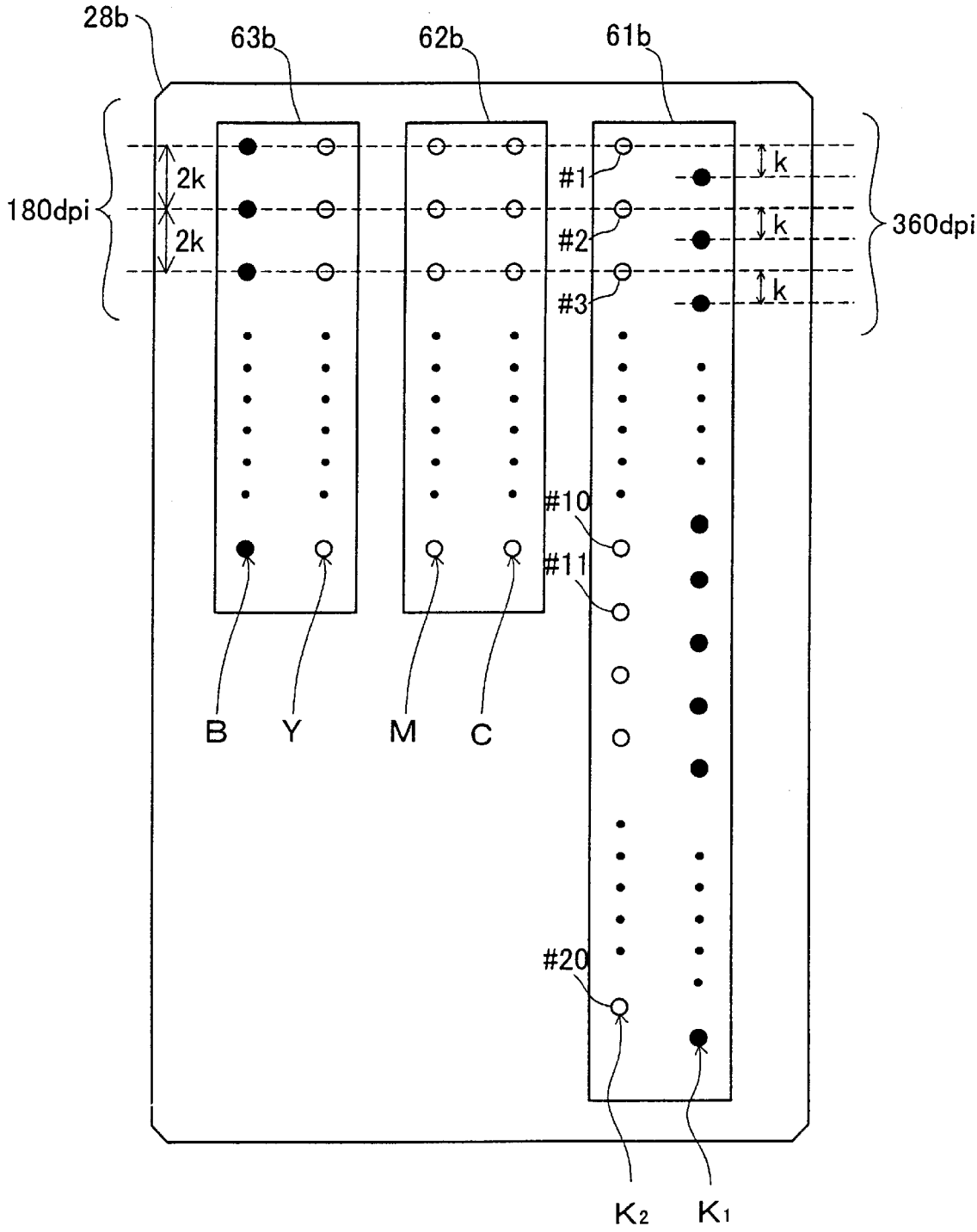
FIG. 14 is a plan view which illustrates the disposition of the nozzles on the printing head 28*b* in a modification of the second embodiment.

B-4. Modification of the second embodiment:

FIG. 14 is a plan view which illustrates the disposition of the nozzles on the printing head 28*b* in a modification of the second embodiment. In the case of this printing head 28*b*, all of the nozzles are used in the nozzle row $K_2$, while none of the nozzles is used in the nozzle row $K_1$. The remaining parts of this head are the same as in the second embodiment. In this modification, nozzles #1~#10 of the nozzle row $K_2$ are assigned to a second partial nozzle group, while nozzles #11~#20 are assigned to a first partial nozzle group. Accordingly, the first partial nozzle group is shifted by 10 pitch intervals relative to the second partial nozzle group. In this modification, two partial nozzle groups that eject the same ink are installed in the same row; accordingly, there is no need to shift the ejection timing as there is in cases where the nozzles are divided into two rows, which makes the control easier. In the present modification, furthermore, nozzle rows B and $K_1$ that are not used are present at both ends of the printing head 28; if such nozzle rows that are not used are omitted, the width of the printing head will be reduced.

In this modification, recording is performed at 180 dpi on the printing medium. Specifically, in the first and second embodiments, the spacing of the raster lines on the printing medium was k; in this modification, however, the spacing of the raster lines is 2 k.

The manner of printing performed by the printing head 28*b* is as follows: specifically, on each forward pass, printing is performed using all of the nozzle rows Y, M, C and $K_2$. Afterward, the control circuit 40 performs a sub-scan by an amount of 20 k, and reverse pass printing is performed. Here, on each reverse pass, printing is performed using only the nozzle rows Y, M and C. For example, in a state in which the first pass has been performed, raster lines 1 through 20 are recorded only with black ink; only raster lines 1 through 10 are recorded with yellow, cyan and magenta inks. Then, a sub-scanning feed of 20 k is performed, and on the subsequent reverse pass, raster lines 11 through 20 are recorded with yellow cyan and magenta inks. Then, before the next forward pass of the main scanning is executed, the control circuit 40 performs a sub-scan feed of 20 k. On the next forward pass, raster line 21 and following raster lines are recorded. A sub-scanning feed of 20 k is also performed prior to the next reverse pass when the forward pass of the main scanning is completed. Meanwhile a sub-scanning feed of 20 k is also performed prior to the next forward pass when the reverse pass of the main scanning is completed.

In this method as well, black dots are recorded only on the forward passes; accordingly, the dot misalignment caused by bidirectional printing does not occur with respect to black ink, and even in cases where straight lines are drawn in the sub-scanning direction, these lines can be drawn completely straight.

C. Other Modifications:

In the printer of the above embodiments, the two nozzle rows that eject black ink droplets are installed together with their positions shifted by a distance equal to a half the nozzle pitch, and each nozzle row is arranged in a single straight line. However, the present invention is also applicable to other configurations. Specifically, in regard to nozzle rows used to perform unidirectional printing, it would also be possible to use a configuration in which one nozzle row is shifted by a distance of (several pitch intervals+½) with respect to the other nozzle row, or a configuration in which the nozzle rows are shifted by several pitch intervals. Even in cases where the two nozzle rows are shifted in the sub-scanning direction by a distance greater than the length of the nozzle rows in the sub-scanning direction, there is no need to installed the nozzle rows in a straight line.

Although the number of black ink nozzles is twice the number of nozzles in each colored ink nozzle row in the above embodiments, the number of nozzles used is not limited to such a number; equal numbers of nozzles may be used, or the number of black ink nozzles may be set at 4 or 6 times that of nozzles in each colored ink nozzle row. Specifically, it is sufficient if the nozzle groups of the printing head used in the present invention include a first type nozzle group used to eject the respective inks of a first ink group that includes at least one ink, and a second type nozzle group used to eject the respective inks of a second ink group that includes at least one ink. However, if the number of nozzles used in unidirectional printing is q times (q is a real number) the number of nozzles used in bidirectional printing, then, in regard to the number of nozzles that can be operated in one forward and reverse passes of the main scanning, the number of black ink nozzles is q/2 times the number of colored ink nozzles.

Here, if the real number q is 2.0, then the same number of nozzles as that used in the case of the forward and return passes with respect to bidirectionally printed inks can be operated on the forward or reverse pass alone with respect to unidirectionally printed inks. Accordingly, in cases where the density of the pixels on the printing medium is the same for unidirectionally printed inks and bidirectionally printed inks, printing can be performed on the same rate with unidirectionally printed inks and bidirectionally printed inks in the forward and return passes of the main scanning.

If the real number q is 2×i (i is a natural number), then a number of nozzles that is a natural-number multiple of the number of nozzles used on the forward and return passes with bidirectionally printed inks can be operated on the forward or reverse passes alone with respect to unidirectionally printed inks. In such a configuration, the following effects can be obtained by dividing the nozzles used in unidirectional printing into partial nozzle groups each having a number of nozzles equal to the number of nozzles used in bidirectional printing, and arranging the partial groups so that the respective nozzles of the partial groups are aligned in the main scanning direction or so that the corresponding nozzles of the partial groups are shifted by an integral multiple of the nozzle pitch. Specifically, when overlap printing is performed, and one raster line is printed with unidirectionally printed inks by a greater number of or a natural-number multiple of nozzles than that used with bidirectionally printed inks, both the unidirectionally and bidirectionally printed inks can be efficiently printed on the same rate if the above mentioned configuration is adopted.

In the second embodiment, a sub-scanning feed of 9 k may be performed prior to the next reverse pass when one forward pass of the main scanning is completed, and a sub-scanning feed of 11 k may be performed prior to the next forward pass when one reverse pass of the main scanning is completed. Specifically, various feeding methods are applicable to the present invention as far as the feeding method is appropriate to the disposition of the nozzles.

Although the colored inks include magenta, cyan and yellow in the above embodiments, it would also be possible to use other inks such as light cyan ink and light magenta ink. It would also be possible to include nozzle rows that eject a light black (gray) ink in addition to colored inks. In the present invention, unidirectionally printed inks are not limited to black, but may also include other inks such as cyan and magenta. Specifically, with respect to the inks which are used alone to print characters or figures, it is preferable to install a number of nozzles that is twice the number of nozzles used for bidirectionally printed inks, in order to perform unidirectional printing with such inks.

In the above embodiments, the first type nozzle group consists of a single nozzle row on one actuator, and each of the first and second partial nozzle groups in the second type nozzle group consists of a single nozzle rows on a single actuator. However, the present invention is not limited to such a configuration; the respective nozzle groups and partial nozzle groups may also be aggregations of nozzles that are present in a plurality of actuators. In this configuration, the numbers of nozzles that constitute the nozzle group can be increased, so that a larger number of raster lines can be recorded in a single main scanning. Accordingly, the time required for printing can be reduced.

In the printing devices of the above embodiments, a printer equipped with a printing head that uses piezo-electric elements for ejecting ink droplets is used. However, it would also be possible to use a printer that ejects ink droplets by some other mechanism. For example, the present invention can be used in various types of printers and other printing devices, including printers in which heaters are powered to eject ink droplets.

The printing devices of the embodiments include computer processing such as the rasterizer. Accordingly, the present invention can be also realized as a recording medium storing programs used to implement the above mentioned processing. Such recording media include various other types of computer readable media, such as flexible disks, CD-ROMs, optical-magnetic disks, IC cards, ROM cartridges, punch cards, printed items on which a bar code is printed, and internal memory devices (memories such as RAMs and ROMs) and external memory devices of computers.

The present invention is not limited by the above mentioned working configurations; the present invention may be worked in various configurations within limits that involve no departure from the spirit of the present invention. For example, some or all of the various types of control processing described in the above embodiments could also be realized using hardware.

What is claimed is:

1. A bidirectional printer configured to form ink dots of a plurality of color inks on a printing medium along forward and reverse passes of main scanning, the printer comprising:

a printing head equipped with a plurality of nozzle groups each having a plurality of nozzles that eject ink droplets of identical color;

a main scanning mechanism configured to perform the main scanning by moving at least one of the printing head and the printing medium;

a head driver configured to cause ejection of ink droplets from at least some of the plurality of nozzles during the main scanning;

a sub-scanning mechanism configured to perform sub-scanning by moving at least one of the printing head and the printing medium; and a controller configured to control printing process, the plurality of nozzle groups including:

a first type nozzle group that is used to eject ink of a first ink group including at least one ink, the first type nozzle group ejecting ink droplets along both the forward and reverse passes of the main scanning, and a second type nozzle group that is used to eject ink of a second ink group including at least one ink, the second type nozzle group ejecting ink droplets along only a selected one of the forward and reverse passes of the main scanning, wherein the second type nozzle group includes 2×i times the number of nozzles in the first type nozzle group where i is an integer of one or more.

2. The bidirectional printer claimed in claim 1, wherein the integer i is 1.

3. A bidirectional printer configured to form ink dots of a plurality of color inks on a printing medium along forward and reverse passes of main scanning, the printer comprising:

a printing head equipped with a plurality of nozzle groups each having a plurality of nozzles that eject ink droplets of identical color;

a main scanning mechanism configured to perform the main scanning by moving at least one of the printing head and the printing medium;

a head driver configured to cause ejection of ink droplets from at least some of the plurality of nozzles during the main scanning;

a sub-scanning mechanism configured to perform sub-scanning by moving at least one of the printing head and the printing medium; and a controller configured to control printing process, the plurality of nozzle groups including:

a first type nozzle group that is used to eject ink of a first ink group including at least one ink, the first type nozzle group ejecting ink droplets along both the forward and reverse passes of the main scanning, and a second type nozzle group that is used to eject ink of a second ink group including at least one ink, the second type nozzle group ejecting ink droplets along only a selected one of the forward and reverse passes of the main scanning, wherein the first type nozzle group includes N nozzles at a fixed pitch of 2 k along the sub-scanning direction where N is an integer more than one, the second type nozzle group includes first and second partial nozzle groups, each of which includes N nozzles at a fixed pitch of 2 k along the sub-scanning direction, and the first partial nozzle group is shifted in the sub-scanning direction by a distance of 2k(m−½) from the second partial nozzle groups wherere m is an integer of one or more.

4. The bidirectional printer claimed in claim 3, wherein the integer m is 1.

5. A bidirectional printer configured to form ink dots of a plurality of color inks on a printing medium along forward and reverse passes of main scanning, the printer comprising:

a printing head equipped with a plurality of nozzle groups each having a plurality of nozzles that eject ink droplets of identical color;

a main scanning mechanism configured to perform the main scanning by moving at least one of the printing head and the printing medium;

a head driver configured to cause ejection of ink droplets from at least some of the plurality of nozzles during the main scanning;

a sub-scanning mechanism configured to perform sub-scanning by moving at least one of the printing head and the printing medium; and a controller configured to control printing process, the plurality of nozzle groups including:

a first type nozzle group that is used to eject ink of a first ink group including at least one ink, the first type nozzle group ejecting ink droplets along both the forward and reverse passes of the main scanning, and a second type nozzle group that is used to eject ink of a second ink group including at least one ink, the second type nozzle group ejecting ink droplets along only a selected one of the forward and reverse passes of the main scanning, wherein the first type nozzle group includes N nozzles at a fixed pitch of k along the sub-scanning direction where N is an integer more than one, the second type nozzle group includes first and second partial nozzle groups, each of which includes N nozzles at a fixed pitch of k along the sub-scanning direction, and the first partial nozzle group is shifted in the sub-scanning direction by a distance of k(j−1) from the second partial nozzle groups where j is an integer of one or more.

6. The bidirectional printer claimed in claim 5, wherein the integer j is equal to (N+1).

7. A bidirectional printer configured to form ink dots of a plurality of color inks on a printing medium along foward and reverse passes of main scanning,the printer comprising:

a printing head equipped with a plurality of nozzle groups each having a plurality of nozzles that eject ink droplets of identical color;

a main scanning mechanism configured to perform the main scanning by moving at least one of the printing head and the printing medium;

a head driver configured to cause ejection of ink droplets from at least some of the plurality of nozzles during the main scanning;

a sub-scanning mechanism configured to perform sub-scanning by moving at least one of the printing head and the printing medium; and a controller configured to control printing process, the plurality of nozzle groups including:

a first type nozzle group that is used to eject ink of a first ink group including at least one ink, the first type nozzle group ejecting ink droplets along both the forward and reverse passes of the main scanning, and a second type nozzle group that is used to eject ink of a second ink group including at least one ink, the second type nozzle group ejecting ink droplets along only a selected one of the forward and reverse passes of the main scanning, wherein the first ink group includes a plurality of colored ink, the second ink group consists of black ink.

8. A bidirectional printer configured to form ink dots of a plurality of color inks on a printing medium along forward and reverse passes of main scanning, the printer comprising:

a printing head equipped with a plurality of nozzle groups each having a plurality of nozzles that eject ink droplets of identical color;

a main scanning mechanism configured to perform the main scanning by moving at least one of the printing head and the printing medium;

a head driver configured to cause ejection of ink droplets from at least some of the plurality of nozzles during the main scanning;

a sub-scanning mechanism configured to perform sub-scanning by moving at least one of the printing head and the printing medium; and a controller configured to control printing process, the plurality of nozzle groups including:

a first type nozzle group that is used to eject ink of a first ink group including at least one ink, the first type nozzle group ejecting ink droplets along both the forward and reverse passes of the main scanning, and a second type nozzle group that is used to eject ink of a second ink group including at least one ink, the second type nozzle group ejecting ink droplets along only a selected one of the forward and reverse passes of the main scanning, further comprising a memory configured to store a correction value used to correct dot misalignment in the main scanning direction on the forward and revere passes, wherein the controller performs a correction of the ejection timing of the ink droplets on the basis of the correction value on at least one of the forward and reverse passes of the main scanning for the first type nozzle group.

9. A printing head suitable for a bidirectional printer configured to form ink dots of a plurality of color inks on a printing medium along forward and reverse passes of main scanning, the printing head comprising:

a plurality of nozzle groups each having a plurality of nozzles that eject ink droplets of identical color;

the plurality of nozzle groups including:

a first type nozzle group that is used to eject ink of a first ink group including at least one ink, the first type nozzle group ejecting ink droplets along both the forward and reverse passes of the main scanning; and a second type nozzle group that is used to eject ink of a second ink group including at least one ink, the second type nozzle group ejecting ink droplets along only a selected one of the forward and reverse passes of the main scanning, the second type nozzle group including 2×i times the number of nozzles in the first type nozzle group where i is an integer of one or more.

10. The printing head claimed in claim 9, wherein the first type nozzle group includes N nozzles at a fixed pitch of 2 k along the sub-scanning direction where N is an integer more than one, the second type nozzle group includes first and second partial nozzle groups, each of which includes N nozzles at a fixed pitch of 2 k along the sub-scanning direction, and the first partial nozzle group is shifted in the sub-scanning direction by a distance of $2\,k(m-½)$ from the second partial nozzle group where m is an integer of one or more.

11. The printing head claimed in claim 10, wherein the integer m is 1.

12. The printing head claimed in claim 9, wherein the first type nozzle group includes N nozzles at a fixed pitch of k along the sub-scanning direction where N is an integer more than one, the second type nozzle group includes first and second partial nozzle groups, each of which includes N nozzles at a fixed pitch of k along the sub-scanning direction, and the first partial nozzle group is shifted in the sub-scanning direction by a distance of $k(j-1)$ from the second partial nozzle groups where j is an integer of one or more.

13. The printing head claimed in claim 12, wherein the integer j is equal to $(N+1)$.

14. A printing control device configured to produce printing data to be supplied to a bidirectional printing device, the printing device being equipped with a printing head which has a first type nozzle group for ejecting ink of a first ink group including at least one ink, and a second type nozzle group for ejecting ink of a second ink group including at least one ink, the printing control device comprising:

a printing data generator configured to generates printing data that is used to cause ejection of ink droplets from the first type nozzle group and the second type nozzle group along a selected one of forward and reverse passes of main scanning, and that is used to cause ejection of ink droplets only from the first type nozzle group on the other one of the forward and reverse passes of the main scanning.

15. The printing control device claimed in claim 14, further comprising a correction controller configured to produce correction control data that is used to correct ejection timing of the ink droplets on the basis of a specific correction value on at least either one of the forward passes and reverse passes of the main scanning with respect to the first type nozzle group.

16. In a bidirectional printer equipped with a printing head having a first type nozzle group for ejecting a first ink group including at least one ink, and a second type nozzle group for ejecting a second ink group including at least one ink, a printing method comprising the steps of:

(a) ejecting ink droplets from the first type nozzle group and the second type nozzle group along a selected one of forward and reverse passes of main scanning, and (b) ejecting ink droplets only from the first type nozzle group along the other of the forward and reverse passes of the main scanning.

17. The printing method claimed in claim 16, further comprising the step of:

(c) correcting ejection timing of the ink droplets on the basis of a specific correction value along at least either one of the forward passes and reverse passes of main scanning with respect to the first type nozzle group.

18. A computer program product for causing a computer to execute printing, the computer being equipped with a bidirectional printing device that has a printing head, the printing head having a first type nozzle group for ejecting a first ink group including at least one ink, and a second type nozzle group for ejecting a second ink group including at least one ink, the computer program product comprising:

a computer readable medium; and a computer program stored on the computer readable medium;

the computer program comprises:

a first program for causing the printing device to eject ink droplets from the first type nozzle group and the second type nozzle group along a selected one of the forward and reverse passes of the main scanning, and a second program for causing the printing device to eject ink droplets only from the first type nozzle group along the other of the forward and reverse passes of the main scanning.

19. The computer program product claimed in claim 18, the computer program further comprising:

a third program for causing the printing device to correct ejection timing of the ink droplets on the basis of a specific correction value on at least either one of the forward and reverse passes of main scanning with respect to the first type nozzle group.

* * * * *